US009140430B2

(12) United States Patent
Broughton

(10) Patent No.: US 9,140,430 B2
(45) Date of Patent: Sep. 22, 2015

(54) METHOD AND SYSTEM FOR MANAGING LIGHT FROM A LIGHT EMITTING DIODE

(71) Applicant: Kevin Charles Broughton, Sharpsburg, GA (US)

(72) Inventor: Kevin Charles Broughton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 172 days.

(21) Appl. No.: 13/828,670

(22) Filed: Mar. 14, 2013

(65) Prior Publication Data

US 2014/0085905 A1 Mar. 27, 2014

Related U.S. Application Data

(63) Continuation-in-part of application No. 13/407,401, filed on Feb. 28, 2012.

(60) Provisional application No. 61/447,173, filed on Feb. 28, 2011, provisional application No. 61/726,365, filed on Nov. 14, 2012, provisional application No. 61/728,475, filed on Nov. 20, 2012.

(51) Int. Cl.

| | |
|---|---|
| ***F21V 13/04*** | (2006.01) |
| ***F21V 7/00*** | (2006.01) |
| ***F21V 5/04*** | (2006.01) |
| ***F21V 5/08*** | (2006.01) |

(Continued)

(52) U.S. Cl.

CPC . *F21V 13/04* (2013.01); *F21V 5/04* (2013.01); *F21V 5/08* (2013.01); *F21W 2131/103* (2013.01); *F21Y 2101/02* (2013.01)

(58) Field of Classification Search

CPC ..... F21V 13/04; F21V 5/04; F21V 5/08; F21W 2131/103; F21Y 2101/02

USPC ..... 362/311.02, 311.08, 335

See application file for complete search history.

(56) References Cited

U.S. PATENT DOCUMENTS

| | | | |
|---|---|---|---|
| 1,758,977 | A | 5/1930 | Rolph |
| 2,254,961 | A | 9/1941 | Harris |

(Continued)

FOREIGN PATENT DOCUMENTS

| | | |
|---|---|---|
| CN | 2750186 | 1/2006 |
| CN | 1737418 | 2/2006 |

(Continued)

OTHER PUBLICATIONS

Streetworks fixture from Cooper Lighting and 2 IES files, Aug. 14, 2001.

(Continued)

*Primary Examiner* — Sikha Roy

(74) *Attorney, Agent, or Firm* — King & Spalding LLP

(57) ABSTRACT

A light source, for example a light emitting diode, can emit light and have an associated optical axis. The source can be deployed in applications where it is desirable to have illumination biased laterally relative to the optical axis, such as in a street luminaire where directing light towards a street is beneficial. The source can be coupled to an optic that comprises a cavity. At least a portion of the cavity can have an outline that is egg-shaped in cross section. A backside of the cavity (or a backside portion of the optic) can have an irregular shape for receiving the light emitting diode, for example to form a receptacle shaped to fit a circuit board on which the light emitting diode is mounted.

18 Claims, 36 Drawing Sheets

(51) Int. Cl.
*F21W 131/103* (2006.01)
*F21Y 101/02* (2006.01)

(56) References Cited

U.S. PATENT DOCUMENTS 2,394,992 A 2/1946 Franck
2,818,500 A 12/1957 Franck
2,908,197 A 10/1959 Wells et al.
3,278,743 A 10/1966 Franck
3,596,136 A 7/1971 Fischer
3,647,148 A 3/1972 Wince
3,927,290 A 12/1975 Denley
4,345,308 A 8/1982 Mouyard et al.
4,460,945 A 7/1984 Chan
4,729,076 A 3/1988 Masami
4,734,836 A 3/1988 Negishi
4,860,177 A 8/1989 Simms
4,907,044 A 3/1990 Schellhorn et al.
4,941,072 A 7/1990 Yasumoto
5,404,869 A 4/1995 Parkyn
5,424,931 A 6/1995 Wheeler
5,636,057 A 6/1997 Dick et al.
5,782,555 A 7/1998 Hochstein
5,857,767 A 1/1999 Hochstein
5,924,788 A 7/1999 Parkyn, Jr.
5,926,320 A 7/1999 Parkyn
5,939,996 A 8/1999 Kniveton et al.
6,045,240 A 4/2000 Hochstein
6,050,707 A 4/2000 Kondo et al.
6,102,558 A 8/2000 Farnoux
6,227,684 B1 5/2001 Wijbenga
6,227,685 B1 5/2001 McDermott
6,273,596 B1 8/2001 Parkyn, Jr.
6,341,466 B1 1/2002 Kehoe et al.
6,345,800 B1 2/2002 Herst et al.
6,441,558 B1 8/2002 Muthu et al.
6,461,008 B1 10/2002 Pederson
6,502,956 B1 1/2003 Wu
6,527,422 B1 3/2003 Hutchison
6,536,923 B1 3/2003 Merz
6,547,423 B2 4/2003 Marshall et al.
6,560,038 B1 5/2003 Parkyn et al.
6,582,103 B1 6/2003 Popovich et al.
6,598,998 B2 7/2003 West et al.
6,639,733 B2 10/2003 Minano
6,784,357 B1 8/2004 Wang
6,785,053 B2 8/2004 Savage, Jr.
6,837,605 B2 1/2005 Reill
6,850,001 B2 2/2005 Takekuma
6,895,334 B2 5/2005 Yabe
6,942,361 B1 9/2005 Kishimura et al.
6,948,838 B2 9/2005 Kunstler
6,965,715 B2 11/2005 Lei
6,997,580 B2 2/2006 Wong
7,070,310 B2 7/2006 Pond et al.
7,073,931 B2 7/2006 Ishida
7,090,370 B2 8/2006 Clark
7,102,172 B2 9/2006 Lynch et al.
7,104,672 B2 9/2006 Zhang
7,153,015 B2 12/2006 Brukilacchio
7,172,319 B2 2/2007 Holder
7,181,378 B2 2/2007 Benifez
7,204,627 B2 4/2007 Ishida
7,237,936 B1 7/2007 Gibson
7,278,761 B2 10/2007 Kuan
7,281,820 B2 10/2007 Bayat et al.
7,322,718 B2 1/2008 Setomoto et al.
D563,036 S 2/2008 Miyairi et al.
7,329,029 B2 2/2008 Chaves et al.
7,329,030 B1 2/2008 Wang
7,329,033 B2 2/2008 Glovatsky
7,339,200 B2 3/2008 Amano et al.
7,347,599 B2 3/2008 Minano et al.
7,348,604 B2 3/2008 Matheson
7,348,723 B2 3/2008 Yamaguchi et al.
7,352,011 B2 4/2008 Smits et al.
7,374,322 B2 5/2008 Steen et al.
7,410,275 B2 8/2008 Sommers et al.
D577,852 S 9/2008 Miyairi et al.
7,460,985 B2 12/2008 Benitez
7,461,948 B2 12/2008 Van Voorst Vader et al.
7,507,001 B2 3/2009 Kit
7,513,639 B2 4/2009 Wang
7,553,051 B2 6/2009 Brass et al.
7,569,802 B1 8/2009 Mullins
7,572,027 B2 8/2009 Zampini, II
7,572,654 B2 8/2009 Chang
7,575,354 B2 8/2009 Woodward
7,582,913 B2 9/2009 Huang et al.
7,618,162 B1 11/2009 Parkyn et al.
7,618,163 B2 11/2009 Wilcox
7,625,102 B2 12/2009 Koike et al.
7,637,633 B2 12/2009 Wong
7,651,240 B2 1/2010 Bayat et al.
7,674,018 B2 3/2010 Holder et al.
7,775,679 B2 8/2010 Thrailkill et al.
7,777,405 B2 8/2010 Steen et al.
7,809,237 B2 10/2010 Pozdnyakov et al.
7,817,909 B2 10/2010 Montgomery et al.
7,841,750 B2 11/2010 Wilcox et al.
7,854,536 B2 12/2010 Holder
7,942,559 B2 5/2011 Holder
7,972,035 B2 7/2011 Boyer
7,972,036 B1 7/2011 Schach et al.
7,985,009 B2 * 7/2011 Ho ..... 362/335
7,993,036 B2 8/2011 Holder et al.
8,007,140 B2 8/2011 Zhang et al.
8,025,428 B2 9/2011 Duguay et al.
8,210,722 B2 7/2012 Holder et al.
8,382,338 B2 2/2013 Lee
8,414,161 B2 4/2013 Holder et al.
2002/0034081 A1 3/2002 Serizawa
2002/0196623 A1 12/2002 Yen
2003/0067787 A1 4/2003 Serizawa
2003/0099115 A1 5/2003 Reill
2004/0004828 A1 1/2004 Chernick
2004/0037076 A1 2/2004 Katoh et al.
2004/0070855 A1 4/2004 Benitez et al.
2004/0105171 A1 6/2004 Minano et al.
2004/0105261 A1 6/2004 Ducharme
2004/0105264 A1 6/2004 Spero
2004/0189933 A1 9/2004 Sun et al.
2004/0207999 A1 10/2004 Suehiro
2004/0218388 A1 11/2004 Suzuki
2004/0222947 A1 11/2004 Newton et al.
2004/0228127 A1 11/2004 Squicciarini
2005/0073849 A1 4/2005 Rhoads et al.
2005/0207165 A1 9/2005 Shimizu et al.
2006/0034082 A1 2/2006 Park
2006/0039143 A1 2/2006 Katoh
2006/0081863 A1 4/2006 Kim et al.
2006/0083003 A1 4/2006 Kim et al.
2006/0138437 A1 6/2006 Huang et al.
2006/0238884 A1 10/2006 Jang
2006/0245083 A1 11/2006 Chou et al.
2006/0250803 A1 11/2006 Chen
2006/0255353 A1 11/2006 Taskar
2006/0285311 A1 12/2006 Chang et al.
2007/0019415 A1 1/2007 Leblanc
2007/0019416 A1 1/2007 Han
2007/0058369 A1 3/2007 Parkyn et al.
2007/0063210 A1 3/2007 Chiu
2007/0066310 A1 3/2007 Haar
2007/0076414 A1 4/2007 Holder
2007/0081338 A1 4/2007 Kuan
2007/0081340 A1 4/2007 Chung et al.
2007/0091615 A1 4/2007 Hsieh et al.
2007/0183736 A1 8/2007 Pozdnyakov
2007/0201225 A1 8/2007 Holder
2007/0258214 A1 11/2007 Shen
2008/0013322 A1 1/2008 Ohkawa
2008/0019129 A1 1/2008 Wang
2008/0025044 A1 1/2008 Park et al.
2008/0043473 A1 2/2008 Matsui

(56) References Cited

U.S. PATENT DOCUMENTS

| | | | | |
|---|---|---|---|---|
| 2008/0055908 | A1 | 3/2008 | Wu | |
| 2008/0068799 | A1 | 3/2008 | Chan | |
| 2008/0080188 | A1 | 4/2008 | Wang | |
| 2008/0100773 | A1 | 5/2008 | Hwang | |
| 2008/0174996 | A1 | 7/2008 | Lu | |
| 2008/0239722 | A1 | 10/2008 | Wilcox | |
| 2008/0273327 | A1 | 11/2008 | Wilcox et al. | |
| 2009/0244895 | A1 | 10/2009 | Chen | |
| 2009/0262543 | A1 | 10/2009 | Ho | |
| 2010/0014290 | A1 | 1/2010 | Wilcox | |
| 2010/0085763 | A1* | 4/2010 | Aguglia | 362/311.06 |
| 2010/0232166 | A1* | 9/2010 | Ho et al. | 362/335 |
| 2011/0075428 | A1* | 3/2011 | Chen et al. | 362/311.02 |
| 2011/0227105 | A1* | 9/2011 | Hwu et al. | 257/91 |
| 2011/0317432 | A1* | 12/2011 | Lee | 362/335 |

FOREIGN PATENT DOCUMENTS

| | | |
|---|---|---|
| DE | 202006015981 | 1/2007 |
| EP | 1431653 | 6/2004 |
| EP | 1686630 | 8/2006 |
| GB | 718425 | 11/1954 |
| GB | 794670 | 5/1958 |
| GB | 815609 | 7/1959 |
| JP | 06-177424 | 6/1994 |
| JP | 11-154766 | 9/1997 |
| JP | 2001-517855 | 9/1998 |
| JP | 2005-062461 | 3/2005 |
| JP | 2009-021086 | 1/2009 |
| KR | 10-2006-0033572 | 4/2006 |
| KR | 10-2006-0071033 | 6/2006 |
| KR | 20070015738 | 2/2007 |
| KR | 20100015957 | 2/2010 |
| KR | 20100105388 | 9/2010 |
| WO | WO 96/24802 | 8/1996 |
| WO | WO 98/33007 | 7/1998 |
| WO | WO 03/044870 | 5/2003 |
| WO | WO 2004/068909 | 8/2004 |
| WO | WO 2005/041254 | 5/2005 |
| WO | WO 2005/057082 | 6/2005 |
| WO | WO 2005/093316 | 10/2005 |
| WO | WO 2007/100837 | 9/2007 |
| WO | WO 2008/144672 | 11/2008 |
| WO | WO 2010/19810 | 2/2010 |
| WO | WO 2011/098515 | 8/2011 |

OTHER PUBLICATIONS

Bisberg, *LED Magazine*, The 5mm. Package Versus the Power LED: Not a Light choice for the Luminaire Designer, pp. 19-21, Dec. 2005. *LED Magazine*, p. 36 Oct. 2005.

International Search Report and Written Opinion for WO 2010-019810 mailed Sep. 30, 2009.

International Search Report and Written Opinion for WO 2008-144672 mailed Nov. 27, 2008.

ISR and Written Opinion of ISA, PCT-US07-05118 mailed Mar. 11, 2008.

Bortz, "Optimal Design of a Non imaging Projection Lens for Use with an LED Light Source and a Rectangular Sheet." SPIE, pp. 130-138, vol. 4092, USA, published 2000.

International Search Report for PCT-US08-64168 mailed on Aug. 15, 2008.

Extended Search Report for EP Application No. 11006191 mailed Nov. 7, 2011.

Extended Search Report for EP Application No. 11006189 mailed Nov. 7, 2011.

Extended Search Report for EP Application No. 11006190 mailed Nov. 7, 2011.

Timinger, Dr. Andreas, *High Performance Optics Design for LEDs*, Strategies in Light, Feb. 2005.

Ries, Harold & Julius Muschaweck, *Tailored Freeform Optical Surfaces*, Optical Society of America, vol. 19, No. 3, Mar. 2002.

Extended Search Report for EP Application No. 08755907.6 mailed May 10, 2012.

Jolley L.B.W. et al., The Therory and Design of Illuminating Engineering Equipment, 1931.

Order; Case No. 11-CV-34-JPS United States District Court Eastern District of Wisconsin; Jun. 8, 2012; (referencing U.S. Patent Nos. 7,674,018 and 7,993,036).

International Search Report for PCT-US11-049388 mailed on Apr. 9, 2012.

Timinger, Andreas, Strategies Unlimited, "Charting New Directions in High-Brightness LED's ," Strategies in Light, Feb. 5-7, 2003.

Timinger, Andreas, "Optical Design for LED-Street Lamps," Conference Paper, Solid-State and Or-ganic Lighting (SOLED), Karlsruhe, Germany, Jun. 21, 2010.

Order, Case No. 11-CV-34-JPS; United States District Court Eastern District of Wisconsin; filed Oct. 31, 2012.

LED's Magazine; High-Power LED's; multi-watt LED light Engines Offer Challenges and Opportun-ities; ledmagazine.com Oct. 2005.

Timinger, "Tailored Optical Surfaces Step up Illumination Design," Europhonics; Aug.-Sep. 2002.

Plantiff Illumination Management Solutions, Inc.'s Initial Claim Construction Brief; Case No. 2:11-cv-00034 JPS; Apr. 5, 2012.

Ruud Lighting's Notice Pursuant to 35 U.S.C. §282; Civil Action 2:11-cv-00034-JPS; Oct. 12, 2012.

Expert Report of Dr. Roland Winston Regarding Invalidity, Civil Action 2:11-cv-00034-JPS; Jul. 17, 2012; Exhibits A-C.

Expert Report of Dr. Rick Mistrick; Validity of the '018 and '036 Patents; Civil Action 2:11-cv-00034-JPS; Aug. 17, 2012.

Expert Report of Dr. Rick Mistrick; Rebuttal of Dr. Roland Winston; Civil Action 2:11-cv-00034-JPS; Aug. 17, 2012.

Expert Report of Waqidi Falicoff; Civil Action 2:11-cv-00034-JPS; Jul. 17, 2012; Exhibits 1-24.

Aoyama, Y.; Yachi, T., "An LED Module Array System Designed for Streetlight Use," Energy 2030 Conference, 2008. Energy 2008. IEEE , vol., no., pp. 1-5, Nov. 17-18, 2008, doi: 10.1109/ENERGY.2008.4780996; URL: http://ieeexplore.ieee.org/stamp/stamp.jsp?tp=&arnumber=4780996&isnumber=4780986.

Petroski, J.; Norley, J.; Schober, J.; Reis, B.; Reynolds, R.A.; , "Conduction cooling of large LED array systems," Thermal and Thermomechanical Phenomena in Electronic Systems (ITherm), 2010 12th IEEE Intersociety Conference on , vol., no., pp. 1-10, Jun. 2-5, 2010; doi: 10.1109/ITHERM.2010.5501350; URL: http://ieeexplore.ieee.org/stamp/stamp.jsp?tp=&arnumber=5501350&isnumber=5501251.

Wankhede, M.; Khaire, V.; Goswami, A.; Mahajan, S.D.; , "Evaluation of Cooling Solutions for Out-door Electronics," Electronics Packaging Technology Conference, 2007. EPTC 2007. 9th , vol., no., pp. 858-863, Dec. 10-12, 2007; doi: 10.1109/EPTC.2007.4469682; URL: http://ieeexplore.ieee.org/stamp/stamp.jsp?tp=&arnumber=4469682&isnumber=4469670.

International Search Report for PCT/US2012/026971; mailed Sep. 27, 2012.

European Search Report for application No. 09807313.3, mailed Sep. 25, 2014.

* cited by examiner

Street Side

House Side

Light Level Contour Plot

Street Side

House Side

Street Side

House Side

METHOD AND SYSTEM FOR MANAGING LIGHT FROM A LIGHT EMITTING DIODE

CROSS REFERENCE TO RELATED APPLICATIONS

This application is a continuation-in-part of and claims priority to U.S. Non-provisional patent application Ser. No. 13/407,401 that was filed on Feb. 28, 2012 in the name of Kevin Charles Broughton and is entitled "Method and System for Managing Light from a Light Emitting Diode," which claims priority to U.S. Provisional Patent Application No. 61/447,173 that was filed on Feb. 28, 2011 in the name of Kevin Charles Broughton and is entitled "Method and System for Managing Light from a Light Emitting Diode;" this application further claims priority to U.S. Provisional Patent Application No. 61,726,365 that was filed on Nov. 14, 2012 in the name of Kevin Charles Broughton and is entitled "Method and System for Managing Light from a Light Emitting Diode;" this application further claims priority to U.S. Provisional Patent Application No. 61/728,475 that was filed on Nov. 20, 2012 in the name of Kevin Charles Broughton and is entitled "Method and System for Redirecting Light from a Light Emitting Diode." Each of the above identified patent applications are hereby incorporated herein by reference. The entire contents of U.S. Non-provisional patent application Ser. No. 13/407,401 and U.S. Provisional Patent Application Nos. 61/447,173; 61,726,365; and 61/728,475 are hereby incorporated herein by reference.

FIELD OF THE TECHNOLOGY

The present technology relates to managing light emitted by one or more light emitting diodes ("LEDs"), including to optical elements that can form a beam from a section of such emitted light and that can apply total internal reflection to direct such a beam towards a desired location.

BACKGROUND

Light emitting diodes are useful for indoor and outdoor illumination, as well as other applications. Many such applications would benefit from an improved technology for managing light produced by a light emitting diode, such as forming an illumination pattern matched or tailored to application parameters.

For example, consider lighting a street running along a row of houses, with a sidewalk between the houses and the street. Conventional, unbiased light emitting diodes could be mounted over the sidewalk, facing down, so that the optical axis of an individual light emitting diode points towards the ground. In this configuration, the unbiased light emitting diode would cast substantially equal amounts of light towards the street and towards the houses. The light emitted from each side of the optical axis continues, whether headed towards the street or the houses. However, most such street lighting applications would benefit from biasing the amount of light illuminating the street relative to the amount of light illuminating the houses. Many street luminaires would thus benefit from a capability to transform house-side light into street-side light.

In view of the foregoing discussion of representative shortcomings in the art, need for improved light management is apparent. Need exists for a compact apparatus to manage light emitted by a light emitting diode. Need further exists for an economical apparatus to manage light emitted by a light emitting diode. Need further exists for a technology that can efficiently manage light emitted by a light emitting diode, resulting in energy conservation. Need further exists for an optical device that can transform light emanating from a light emitting diode into a desired pattern, for example aggressively redirecting one or more selected sections of the emanating light. Need further exists for technology that can directionally bias light emitted by a light emitting diode. Need exists for a technology that can reduce size, mass, or material usage of an optical element manipulates light emitted by a light emitting diode. Need exists for a technology that facilitates mounting an optical element with or to a light emitting diode. Need exists for integrating chip-on-board systems with optics. Need exists for improved lighting, including street luminaires, outdoor lighting, and general illumination. A capability addressing such need, or some other related deficiency in the art, would support cost effective deployment of light emitting diodes in lighting and other applications.

SUMMARY

An apparatus can process light emitted by one or more light emitting diodes to form a desired illumination pattern, for example successively applying refraction and total internal reflection to light headed in certain directions, resulting in beneficial redirection of that light.

In one aspect of the present technology, a light emitting diode can produce light and have an associated optical axis. A body of optical material can be oriented with respect to the light emitting diode to process the produced light. The body can be either seamless or formed from multiple elements joined or bonded together, for example. A first section of the produced light can transmit through the body of optical material, for example towards an area to be illuminated. The body of optical material can redirect a second section of the produced light, for example so that light headed in a non-strategic direction is redirected towards the area to be illuminated. A refractive surface on an interior side of the body of optical material can form a beam from the second section of the produced light. The beam can propagate in the optical material at an angle relative to the optical axis of the light emitting diode while heading towards a reflective surface on an exterior side of the body of optical material. Upon beam incidence, the reflective surface can redirect the beam out of the body of optical material, for example through a surface region that refracts the beam as the beam exits the body of optical material. The refraction can cause beam divergence, for example. The reflective surface can be reflective as a result of comprising an interface between a transparent optical material having a relatively high refractive index and an optical medium having relatively low refractive index, such as a totally internally reflective interface between optical plastic and air. Alternatively, the reflective surface can comprise a coating that is reflective, such as a sputtered aluminum coating applied to a region of the body of optical material.

In one aspect of the present technology, an optic can receive light from a light emitting diode. The light emitting diode can comprise a chip-on-board light emitting diode package. The optic can comprise a cavity into which the light emitting diode emits light. The chip-on-board light emitting diode package can be mounted adjacent the cavity, for example in a recess or receptacle of the optic. Such a recess or receptacle of the optic may be viewed as part of the cavity. The recess or receptacle can be irregularly shaped, for example.

In one aspect of the present technology, an optic can receive light from a light emitting diode. The optic can comprise a cavity into which the light emitting diode emits light. The cavity can have an outline or footprint when viewed from overhead (or underneath). The outline can be egg-shaped, for example formed by a combination of two different ovals or ellipses that have different elongations.

In one aspect of the present technology, a light emitting diode can emit light into an associated optic that comprises molded plastic material. Ray tracing can indicate portions of the optic that implement most or essentially all of the relevant ray management and other portions of the optic that relevant rays essentially miss. The portions of the optic that the relevant rays miss or bypass can be eliminated as optically inactive or as having low optical relevance from a light management perspective. Eliminating such portions of the optic, for example peripheral regions disposed laterally with respect to the light emitting diode, can reduce the amount of plastic material in the optic, the mass of the optic, and/or the footprint of the optic. By implementing the reduction via reshaping the fabrication mold, the fabrication process can be improved. For example, reducing the overall size of the molded optic can improve dimensional stability during cooling, thus supporting enhanced optical performance and optical consistency.

The foregoing discussion of managing light and systems incorporating light emitting diodes is for illustrative purposes only. Various aspects of the present technology may be more clearly understood and appreciated from a review of the following detailed description of the disclosed embodiments and by reference to the drawings and the claims that follow. Moreover, other aspects, systems, methods, features, advantages, and objects of the present technology will become apparent to one with skill in the art upon examination of the following drawings and detailed description. It is intended that all such aspects, systems, methods, features, advantages, and objects are to be included within this description, are to be within the scope of the present technology, and are to be protected by the accompanying claims.

BRIEF DESCRIPTION OF THE DRAWINGS

FIGS. 5A, 5B, and 5C are taken from different vantage points looking at the light-emitting side of the optic. FIGS. 5E and 5F are taken from different vantage points looking at the light-receiving side of the optic.

FIG. 22, are cutaway perspective views (shown shaded and un-shaded) of the optic of FIG. 19 for managing light emitted by a light emitting diode according to some example embodiments of the present technology.

FIG. 23, are overhead views (shown shaded and un-shaded) of the optic of FIG. 19 for managing light emitted by a light emitting diode according to some example embodiments of the present technology.

FIG. 24, are side views (shown shaded and un-shaded) of the optic of FIG. 19 for managing light emitted by a light emitting diode according to some example embodiments of the present technology.

FIG. 32, are rendered perspective views of the underside of the optic of FIG. 19, for managing light emitted by a light emitting diode according to some example embodiments of the present technology. FIG. 32A shows the underside of the optic without an accompanying light emitting diode, while FIG. 32B shows the underside with an accompanying light emitting diode.

FIG. 33, are rendered views of the underside of the optic of FIG. 19, for managing light emitted by a light emitting diode according to some example embodiments of the present technology. FIG. 33A shows the underside of the optic without an accompanying light emitting diode, while FIG. 33B shows the underside with an accompanying light emitting diode.

FIG. 34, are views of the underside of an optic for managing light emitted by a light emitting diode according to some example embodiments of the present technology.

FIG. 35, are bottom views of the optic of FIG. 19, showing the optic's cavity shaded and un-shaded, for managing light emitted by a light emitting diode according to some example embodiments of the present technology.

FIG. 36, are bottom views of the optic of FIG. 19 with an accompanying light emitting diode, showing the light emitting diode shaded and un-shaded, according to some example embodiments of the present technology.

FIG. 37, are views of an optic for managing light emitted by a light emitting diode according to some example embodiments of the present technology. FIGS. 37A and 37B respectively show the optic in clear form (wire frame) and as opaque prior to eliminating optically inactive portions of optical material to promote manufacturing efficiency. FIGS. 37C and 37D respectively show the optic in clear form (wire frame) and as opaque after eliminating optically inactive portions of optical material to promote manufacturing efficiency.

FIG. 38, are views of an optic for managing light emitted by a light emitting diode according to some example embodiments of the present technology. FIG. 38A shows the optic prior to eliminating optically inactive portions of optical material to promote manufacturing efficiency. FIG. 38B shows the optic after eliminating optically inactive portions of optical material to promote manufacturing efficiency. FIGS. 38C and 38D show the optic with overlaid ray traces in two views after eliminating optically inactive portions of optical material to promote manufacturing efficiency.

FIG. 39, are overhead views of an optic for managing light emitted by a light emitting diode according to some example embodiments of the present technology. The views show a representative outline of a cavity of the optic, where the outline is egg-shaped.

Figure 1:
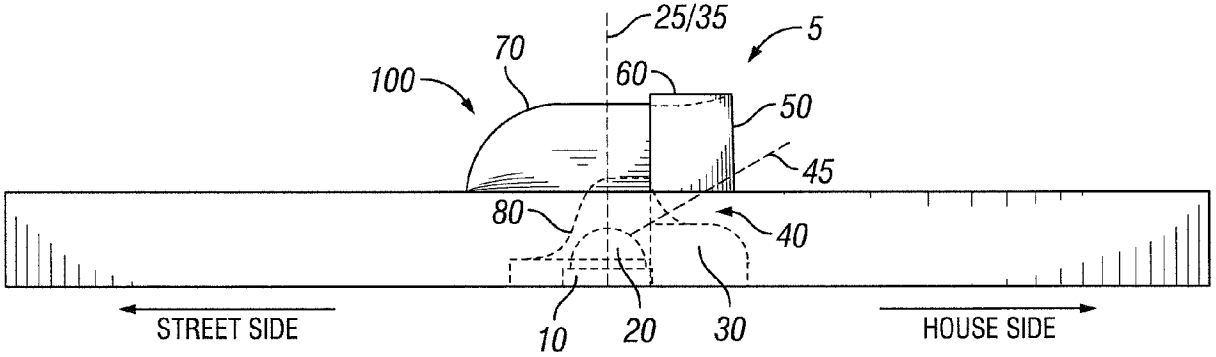
FIG. 1 is an illustration of an illumination system comprising a light emitting diode and an optic that manages light emitted by the light emitting diode according to some example embodiments of the present technology.

Many aspects of the technology can be better understood with reference to the above drawings. The elements and features shown in the drawings are not necessarily all to scale, emphasis instead being placed upon clearly illustrating the principles of example embodiments of the present technology. Moreover, certain dimensions may be exaggerated to help visually convey such principles. In the drawings, reference numerals designate like or corresponding, but not necessarily identical, elements throughout the several views.

DESCRIPTION OF EXAMPLE EMBODIMENTS

A light source can emit light. In some embodiments, the light source can be or comprise one or more light emitting diodes, for example. The light source and/or the emitted light can have an associated optical axis. The light source can be deployed in applications where it is desirable to bias illumination laterally relative to the optical axis. For example, in a street luminaire where the optical axis is pointed down towards the ground, it may be beneficial to direct light towards the street side of the optical axis, rather than towards a row of houses that are beside the street. The light source can be coupled to an optic that receives light propagating on one side of the optical axis and redirects that light across the optical axis. For example, the optic can receive light that is headed towards the houses and redirect that light towards the street.

The optic can comprise an inner surface facing the light source and an outer surface facing away from the light source, opposite the inner surface. The inner surface can comprise a refractive feature that receives light headed away from the optical axis of the light source, for example away from the street to be lighted. The refractive feature can comprise a convex lens surface bulging towards the light source, for example. The refractive feature can form the received, incident light into a beam headed along another optical axis. That optical axis can form an acute angle with respect to the optical axis of the light source itself. The outer surface of the optic can comprise a reflective feature that receives the beam. The reflective feature can comprise a totally internally reflective surface that reflects part, most, or substantially all of the beam back across the optical axis. In some embodiments, the reflected beam exits the optic through a surface that causes the beam to diverge. The surface can be concave, for example. Accordingly, the optic can form a beam from light headed in a non-strategic direction and redirect the beam in a strategic direction.

In some embodiments, the optic can comprise a cavity that has an egg-shaped outline, where the cavity receives light from the light source. The egg-shaped outline may be oval shaped with one end or side fattened relative to the other.

In some embodiments, the optic comprises a receptacle in which the light source is seated or is otherwise disposed. The receptacle may be irregularly shaped to receive a circuit board to which one or more light emitting diodes is mounted, for example.

In some embodiments, portions of the optic that are not optically functional or useful are eliminated. For example, the optic may have a truncated design so that an optically inactive sidewall of the optic extends between two corners of the optic, thereby promoting efficient molding.

In some embodiments, the optic diverts light to its backside, underside, or base, where a portion of the diverted light is sent in a beneficial direction, such as to illuminate a street.

Figure 7:
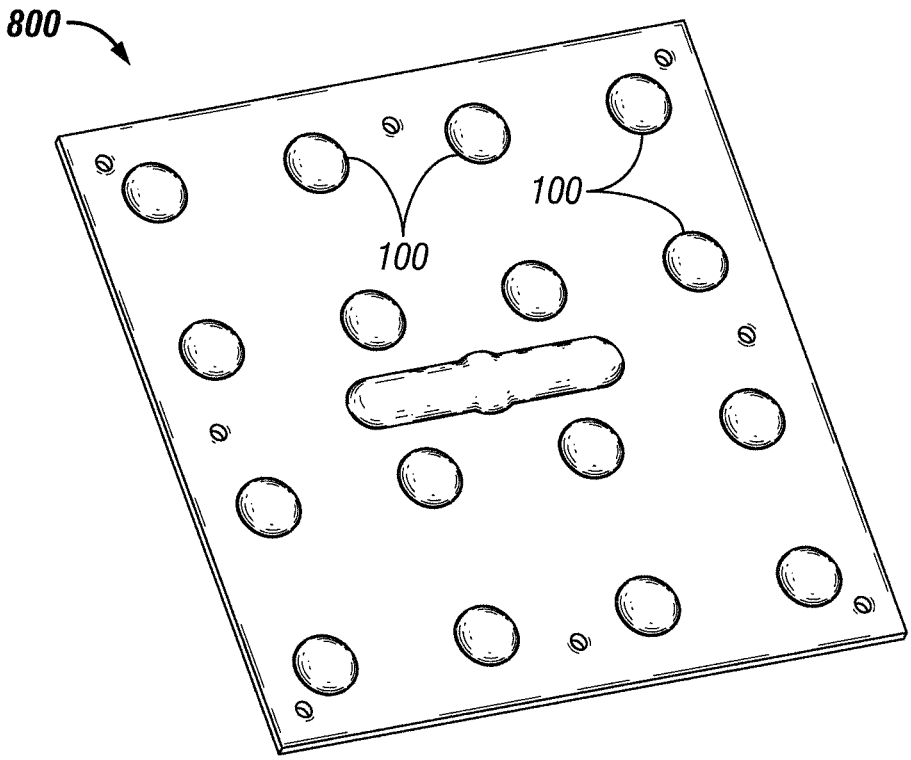
FIG. 7 is an illustration of an array of optics for coupling to a corresponding array of light emitting diodes to provide an array of the illumination systems illustrated in FIG. 1 according to some example embodiments of the present technology.
Figure 17:
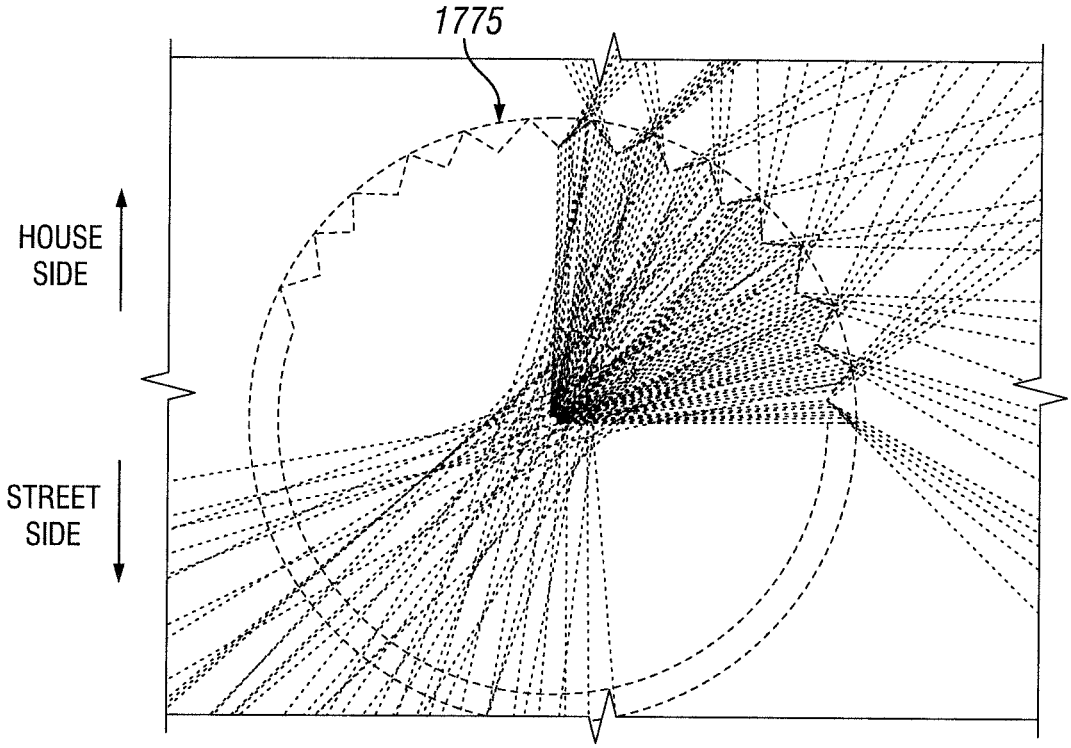
FIG. 17 is a plan view illustration of representative computer-generated ray traces for another embodiment of the illumination system that FIG. 13 illustrates according to some example embodiments of the present technology.
Figure 18:
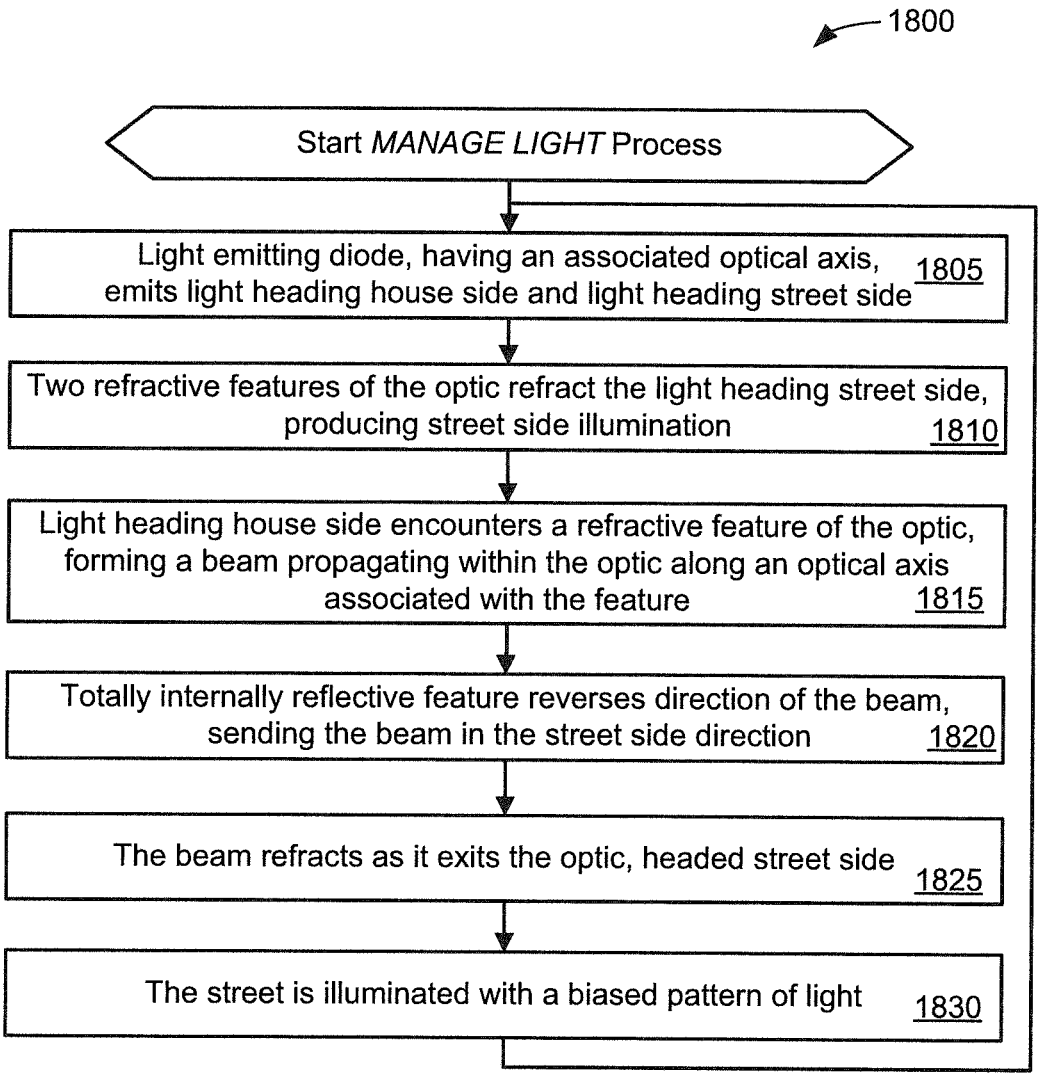
FIG. 18 is a flow chart of a process for managing light emitted by a light emitting diode according to some example embodiments of the present technology.

Technology for managing light emitted by a light emitting diode or other light source will now be described more fully with reference to FIGS. 1-39, which describe representative embodiments of the present technology. FIGS. 1, 2, 3, 4, 5, and 6 describe certain representative embodiments of an illumination system comprising a light emitting diode and an associated optic. FIG. 7 describes certain representative embodiments of a sheet comprising a two-dimensional array of optics for managing light emitted by a corresponding array of light emitting diodes. FIGS. 8, 9, 10, 11, and 12 describe certain representative embodiments of an optic for managing light emitted by a light emitting diode. FIGS. 13, 14, 15, 16, and 17 describe certain representative embodiments of an optic for managing light emitted by a light emitting diode. FIG. 18 describes a method or process for managing light emitted by a light emitting diode. FIGS. 19-39 describe additional embodiments that may comprise a cavity having an egg-shaped outline, a receptacle that receives a circuit board, an optically inactive sidewall, and/or a backside or base that manipulates light. The teaching presented herein is sufficiently detailed and rich so that one of ordinary skill in the art having benefit of this disclosure can readily apply the features illustrated in FIGS. 19-39 to the embodiments of FIGS. 1-39. Moreover, the various illustrated embodiments may be distinct and/or may have common features.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "example embodiments," or "exemplary embodiments" given herein are intended to be non-limiting and among others supported by representations of the present technology.

Turning now to FIGS. 1, 2, 3, 4, 5A, 5B, 5C, 5D, 5E, 6A, 6B, 6C, 6D, and 6E, these figures provide illustrations describing an example embodiment of the present technology as may be applied for street illumination, as well as for other uses. As illustrated, an illumination system 5 can comprise a light emitting diode 10 that produces and emits light and an associated optic 100 managing the light so emitted. As discussed in further detail below, the light emitting diode 10 can produce light that is headed house side, opposite from the street (see light 210 illustrated in FIG. 2), and other light that is headed street side (opposite light 210 illustrated in FIG. 2). The optic 100 can redirect a substantial portion of the house-side light towards the street, where higher illumination intensity is often desired.

Those of ordinary skill having benefit of this disclosure will appreciate that street illumination is but one of many applications that the present technology supports. The present technology can be applied in numerous lighting systems and illumination applications, including indoor and outdoor lighting, automobiles, general transportation lighting, and portable lights, to mention a few representative examples without limitation.

Figure 2:
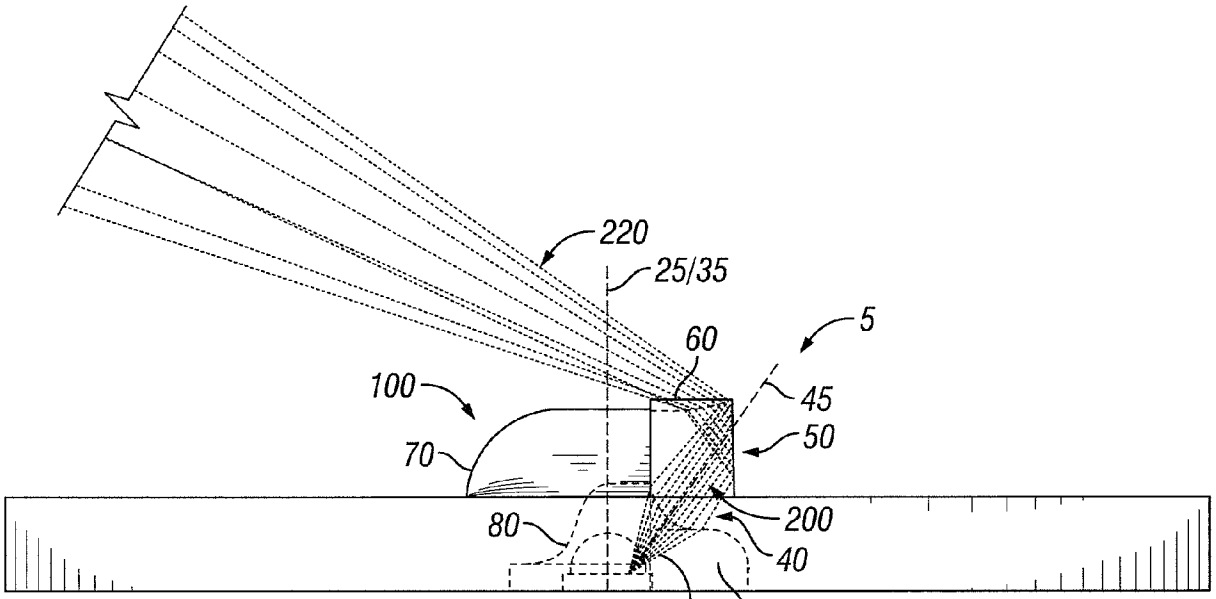
FIG. 2 is another illustration of the illumination system that FIG. 1 illustrates, further illustrating the optic managing representative rays emitted by the light emitting diode according to some example embodiments of the present technology.
Figure 3:
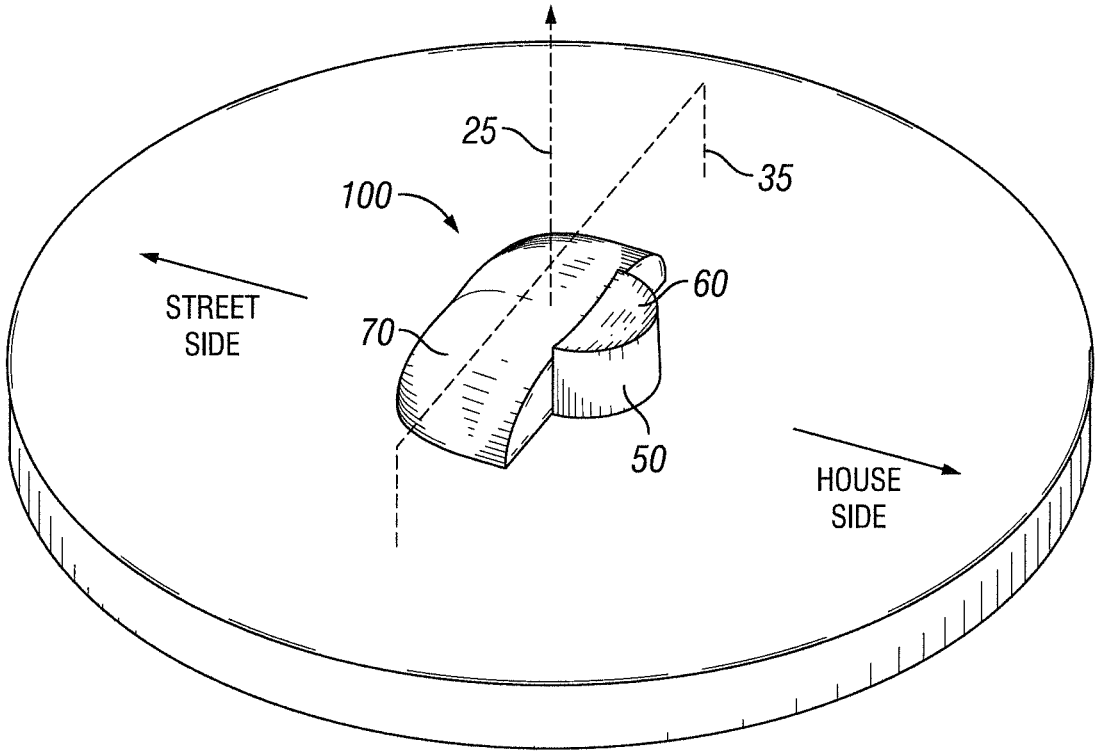
FIG. 3 is a perspective view of the illumination system that FIG. 1 illustrates, wherein the optic is depicted as opaque to promote reader visualization according to some example embodiments of the present technology.
Figure 4:
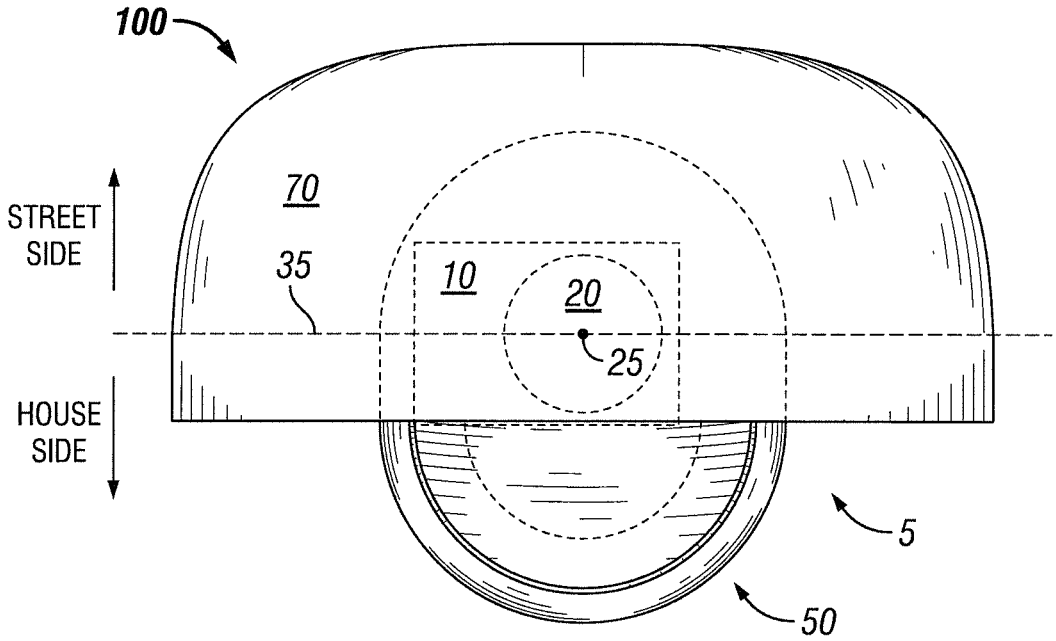
FIG. 4 is a plan view illustration of the illumination system that FIG. 1 illustrates, from a vantage point on the optical axis of the light emitting diode (looking at the light-emitting side of the optic) according to some example embodiments of the present technology.

FIGS. 1, 2, 3, 4, 5A, 5B, 5C, 5D, and 5E illustrate the optic 100 that manages light emitted by the light emitting diode 10. FIGS. 1 and 2 illustrate a side view, with FIG. 2 illustrating ray paths for a section 210 of light emitted from the light emitting diode 10. FIG. 3 illustrates a perspective view. FIG. 4 illustrates a plan view, specifically from a perspective looking down the optical axis 25 towards the light emitting dome 20 of the light emitting diode 10. Thus, if the light emitting diode 10 was mounted overhead so as to emit light towards the ground, the observer would be below the light emitting diode 10 looking straight up; and, if the light emitting diode was mounted on the ground so at to emit light towards the sky or a ceiling, the observer would be above the light emitting diode 10 looking straight down.

Figure 5A:
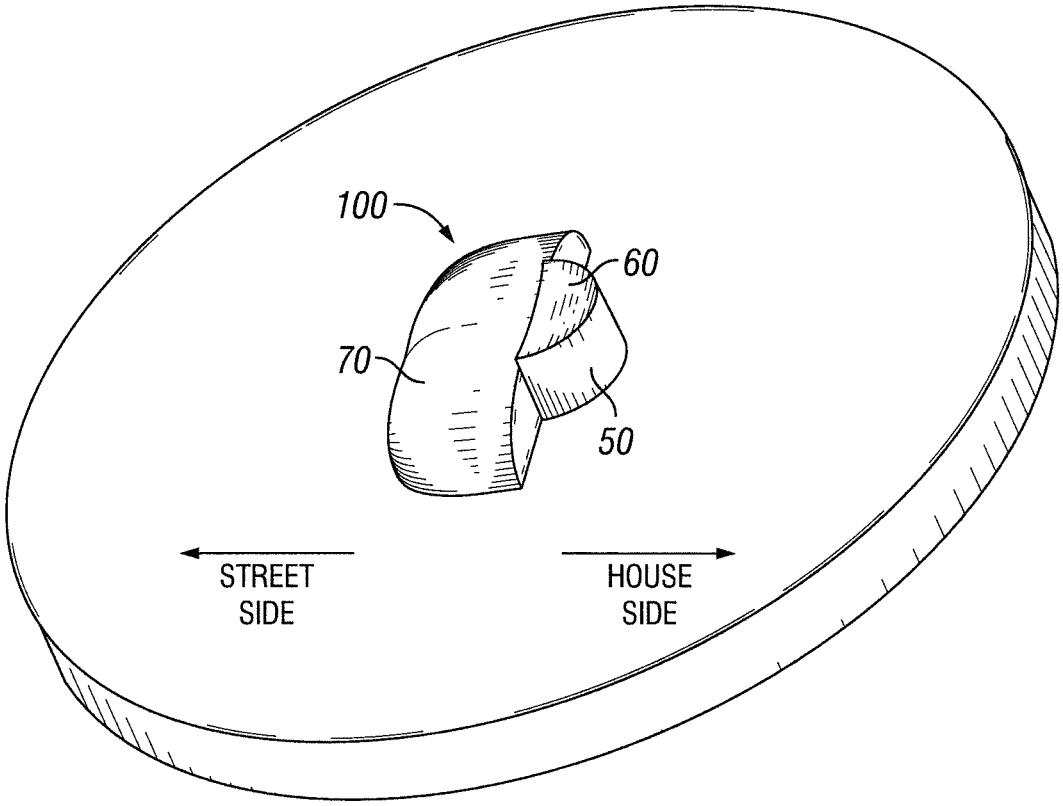
FIGS. 5A, 5B, 5C, 5D, and 5E (collectively FIG. 5) are perspective views of the optic that FIG. 1 illustrates, where the optic is depicted as opaque to promote reader visualization according to some example embodiments of the present technology.
Figure 5B:
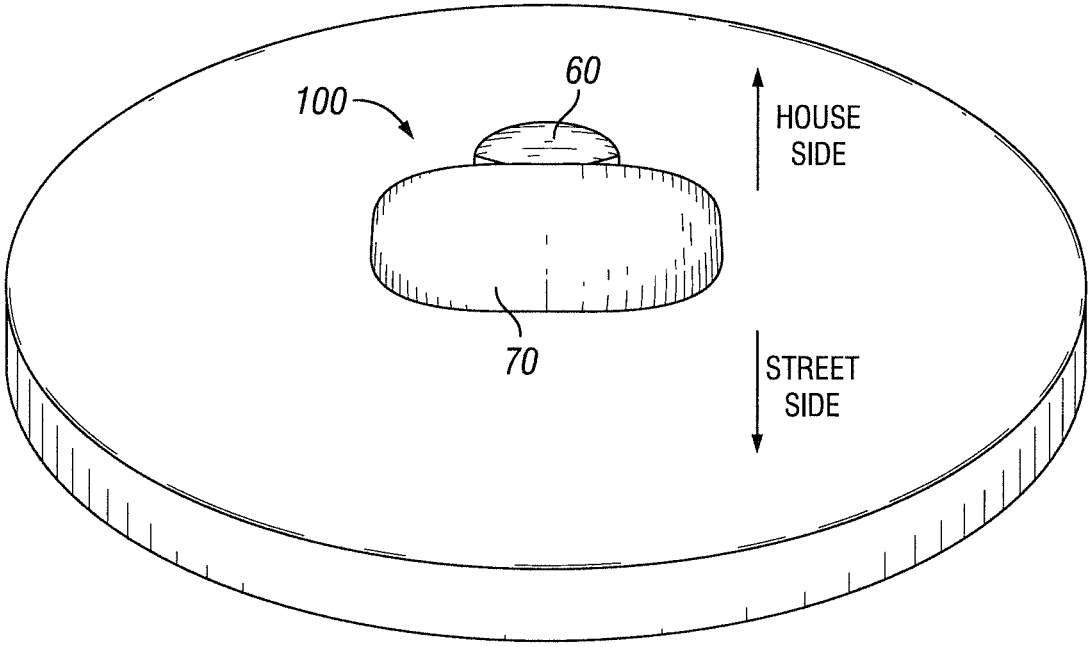
Figure 5C:
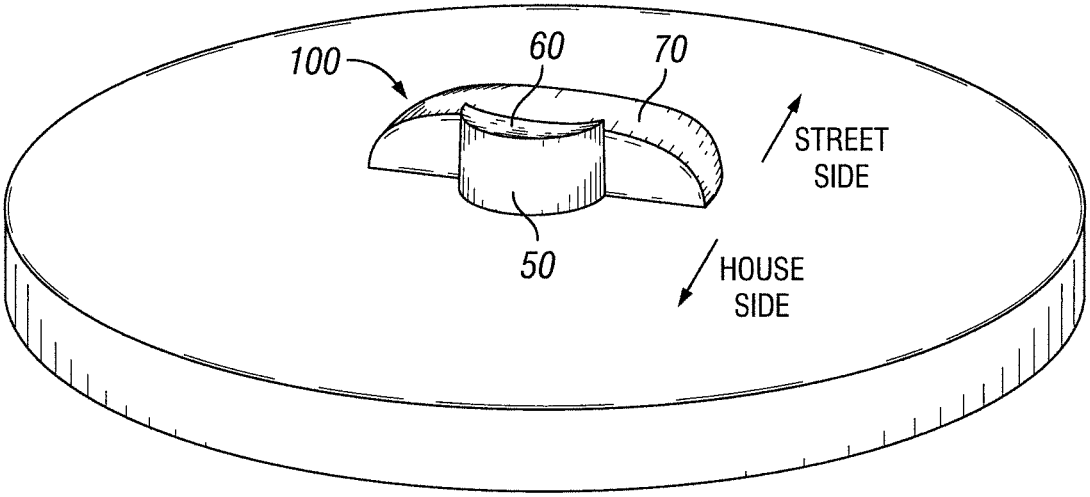
Figure 5D:
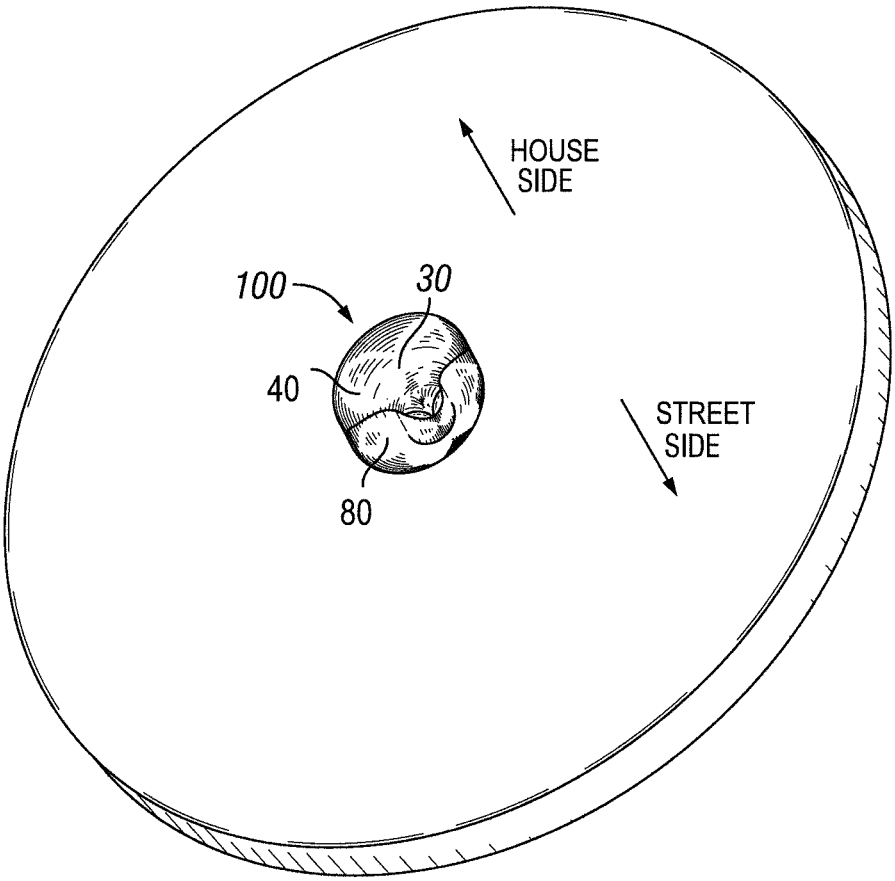
Figure 5E:
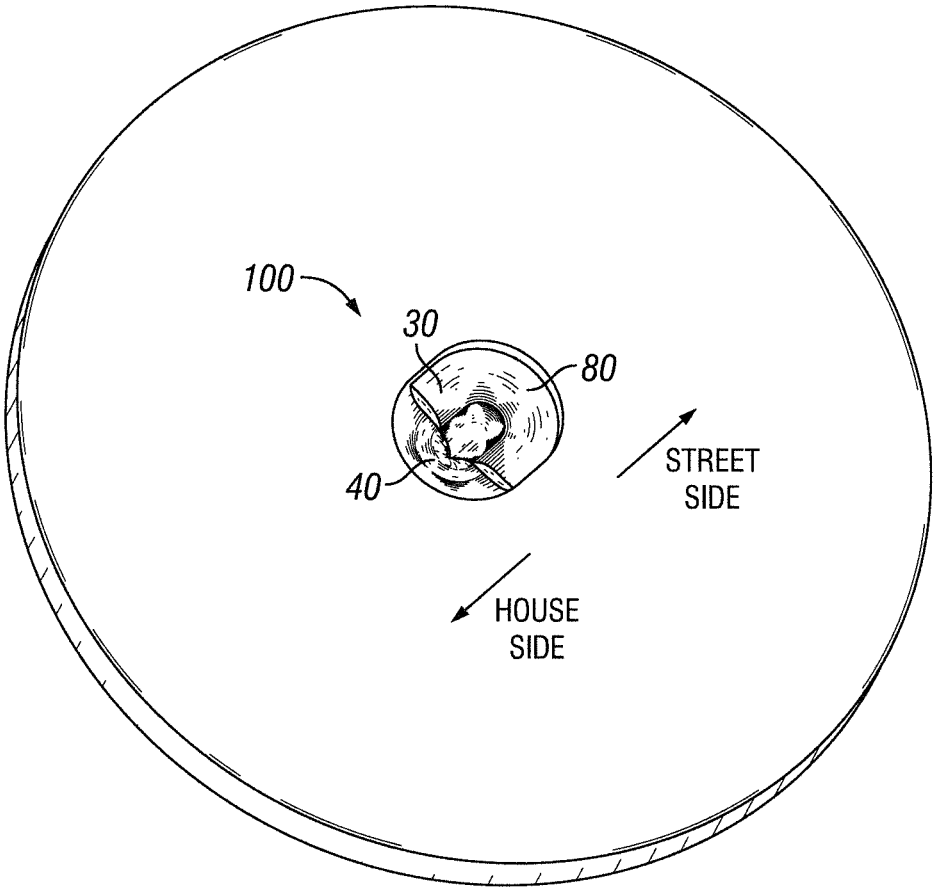
Figure 6A:
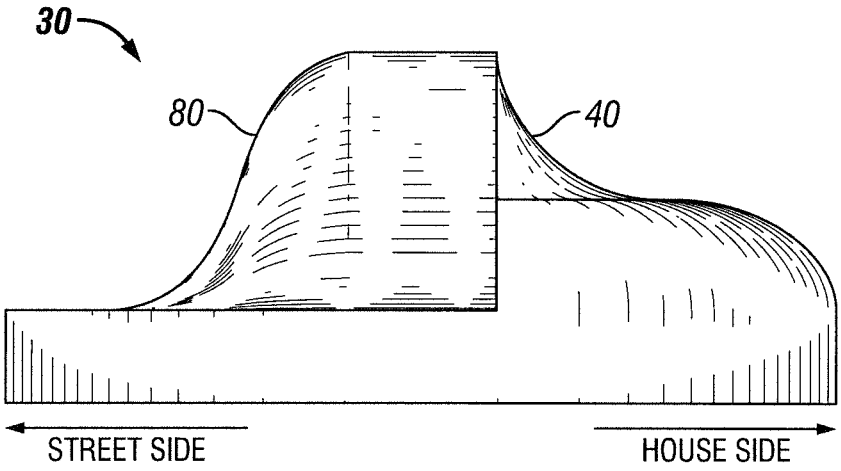
FIGS. 6A, 6B, 6C, 6D, and 6E (collectively FIG. 6) are illustrations, from different perspectives, of a cavity on the light-receiving side of the optic that FIG. 1 illustrates, where the cavity is depicted as a solid, opaque three-dimensional rendering of the cavity to promote reader visualization according to some example embodiments of the present technology. Thus, FIG. 6 describes representative contours of the light-receiving side of the optic by depicting a computer generated solid of the type that could formed by filling the cavity of the optic with a resin, curing the resin, and then separating the cured, solid resin from the optic.
Figure 6B:
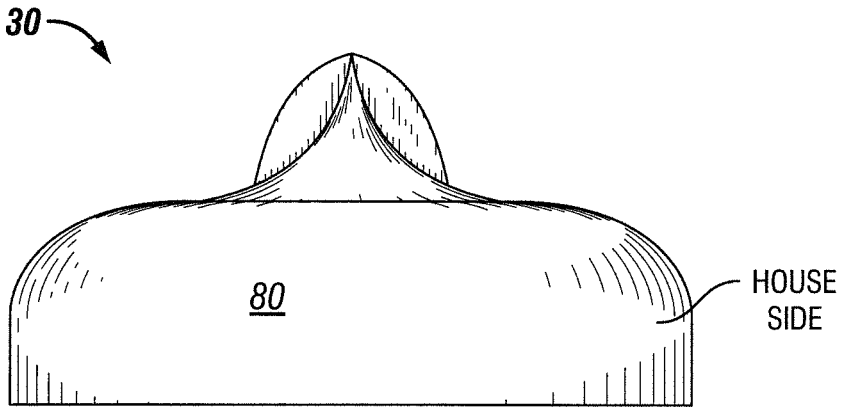
Figure 6C:
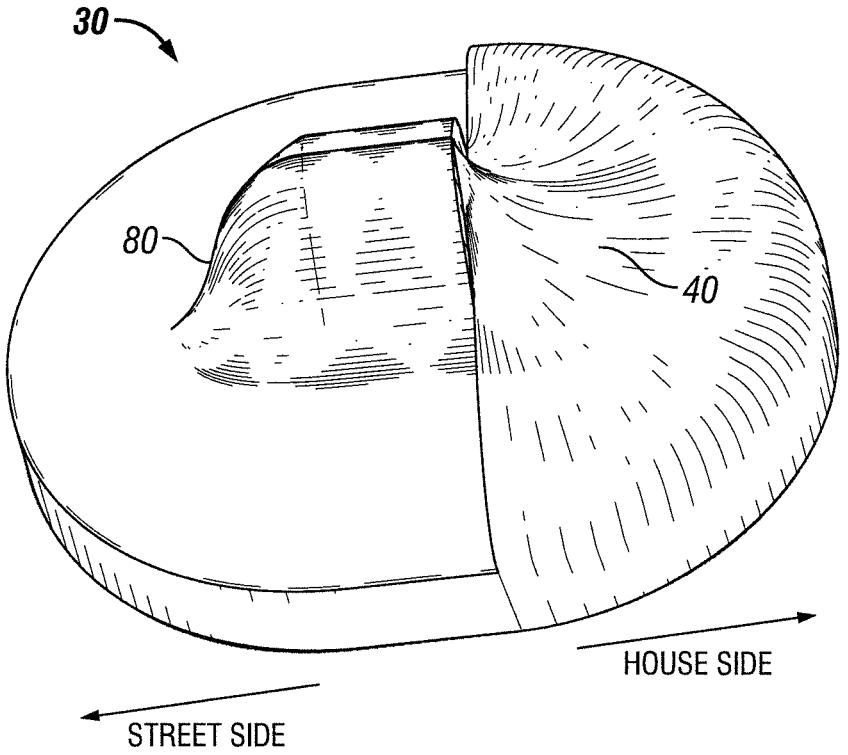
Figure 6D:
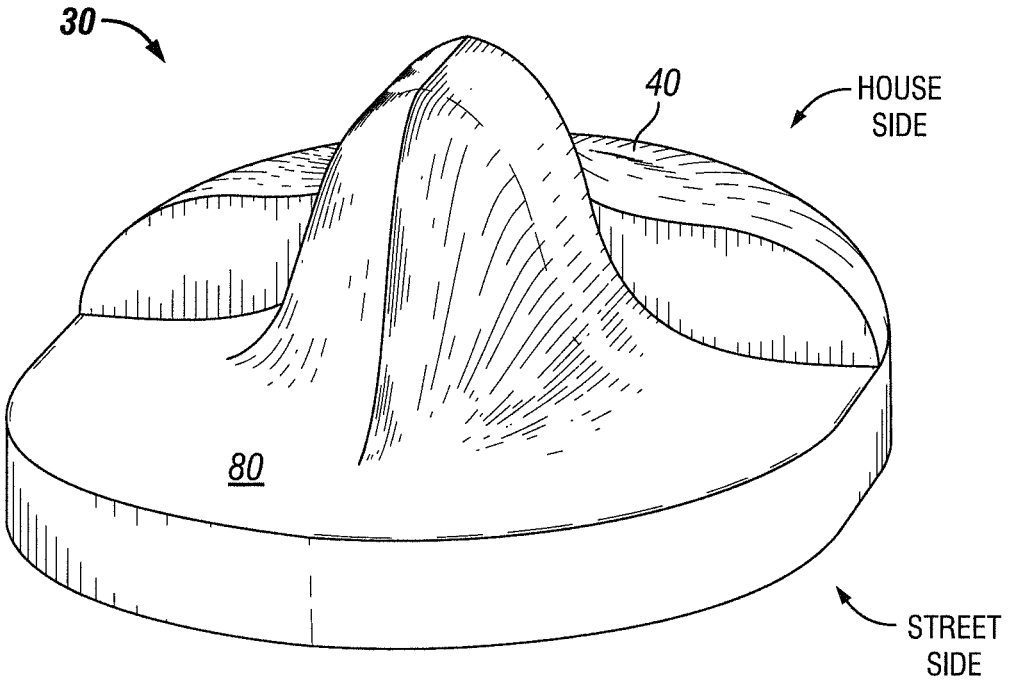
Figure 6E:
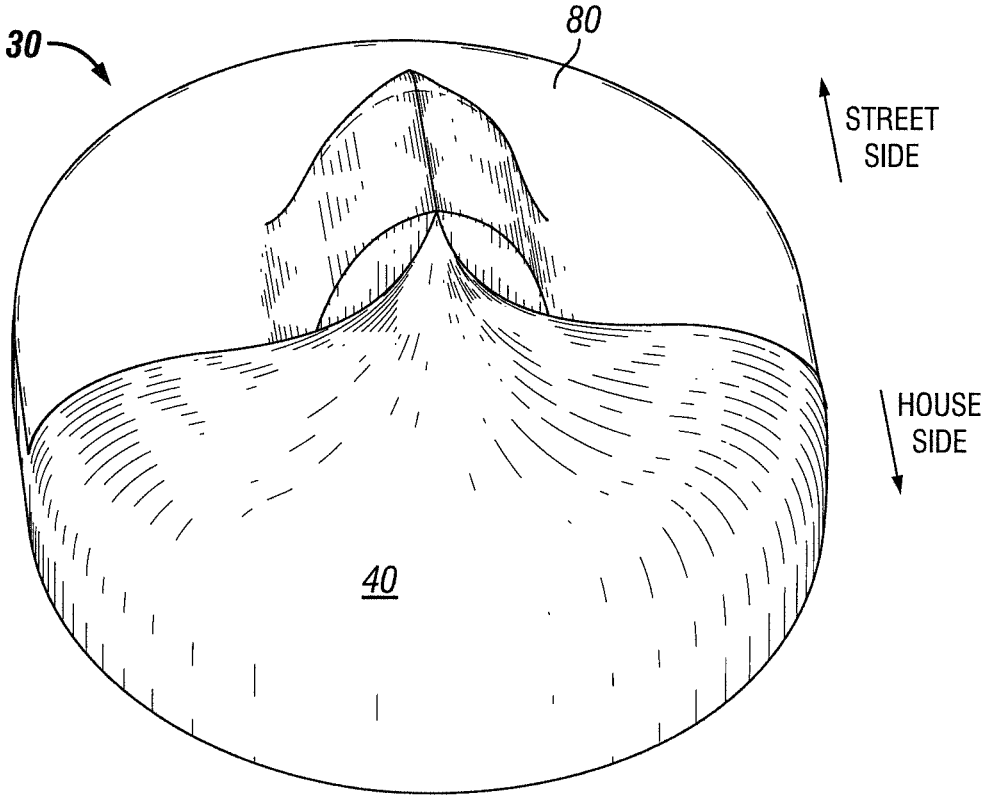

FIGS. 5A, 5B, 5C, 5D, and 5E illustrate the optic 100 as a three-dimensional rendering from five respective perspectives. The rendering of these illustrations represents the optic 100 as an opaque solid to facilitate visualization of transparent optical material. The views of FIGS. 5A, 5B, and 5C are taken from vantage points on the side of the optic 100 that is opposite the light emitting diode 10. Thus, the observer is on the side of the optic 100 that emits light (facing the outer side of the optic 100), but off the axis 25 shown in FIGS. 1, 3 and 4. The views of FIGS. 5D and 5E are taken from the LED-side of the optic 100, looking into a cavity 30 that the optic 100 comprises. Thus, the observer is on the side of the optic that receives light from the light emitting diode 10 (facing the inner side of the optic 100), again off the axis 25. The cavity 30 faces and receives light from the light emitting diode 10.

FIGS. 6A, 6B, 6C, 6D, and 6E illustrate the cavity 30 in the form of a three-dimensional solid rendering (from five perspective views) to facilitate reader visualization. In other words, to show example surface contours of the example cavity 30, FIGS. 6A, 6B, 6C, 6D, and 6E depict a solid that would be formed by filling the cavity 30 with an opaque resin, curing the resin, and then removing the resulting solid.

The illustrated light emitting diode 10 (see FIGS. 1, 2 and 4) comprises an integral dome 20 that provides environmental protection to the light emitting diode's semiconductor materials and that emits the light that the light emitting diode 10 generates. The dome 20 projects or protrudes into the cavity 30 that the optic 100 forms. In some example embodiments, the dome 20 comprises material that encapsulates the light generating optical element of the light emitting diode 10, for example an optoelectronic semiconductor structure or feature on a substrate of the light emitting diode 10. In some example embodiments, the dome 20 radiates light at highly diverse angles, for example providing a light distribution pattern that can be characterized, modeled, or approximated as Lambertian.

The illustrated light emitting diode 10 comprises an optical axis 25 associated with the pattern of light emitting from the dome 20 and/or associated with physical structure or mechanical features of the light emitting diode 10. The term "optical axis," as used herein, generally refers to a reference line along which there is some degree of rotational or other symmetry in an optical system, or a reference line defining a path along which light propagates through a system. Such reference lines are often imaginary or intangible lines. In the illustrated embodiment, the optical axis 25 lies in a reference plane 35 that sections the light emitting dome 20, and/or the associated light emission pattern of the light emitting diode 10, into two portions. Although illustrated in a particular position, the reference plane 35 can positioned in other locations that may or may not be arbitrary. As will be appreciated by those of ordinary skill having benefit of this disclosure, a "reference plane" can be thought of as an imaginary or intangible plane providing a useful aid in describing, characterizing, or visualizing something.

The cavity 30 comprises an inner refractive surface 80 opposite an outer refractive surface 70. Light emitted from the street side of the dome 20 and that is headed street side is incident upon the inner refractive surface 80, transmits through the optic 100, and passes through the outer refractive surface 70. Such light may be characterized as a solid angle or represented as a ray or a bundle of rays. Accordingly, the light that is emitted from the light emitting diode 10 and headed street side continues heading street side after interacting with the optic 100. The inner refractive surface 80 and the outer refractive surface 70 cooperatively manipulate this light with sequential refraction to produce a selected pattern, for example concentrating the light downward or outward depending upon desired level of beam spread. In the illustrated embodiment, the light sequentially encounters and is processed by two refractive interfaces of the optic 100, first as the light enters the optic 100, and second as the light exits the optic 100.

One of ordinary skill in the art having benefit of the enabling teaching in this disclosure will appreciate that the inner refractive surface 80 and the outer refractive surface 70 can be formed to spread, concentrate, bend, or otherwise manage the light emitted street side according to various application parameters. In various embodiments, the inner and outer refractive surfaces 80 and 70 can be concave or convex. In one embodiment, the inner refractive surface 80 is convex and the outer refractive surface 70 is convex. In one embodiment, the inner refractive surface 80 is convex and the outer refractive surface 70 is concave. In one embodiment, the inner refractive surface 80 is concave and the outer refractive surface 70 is convex. In one embodiment, the inner refractive surface 80 is concave and the outer refractive surface 70 is concave. In some embodiments, at least one of the inner refractive surface 80 and the outer refractive surface 70 may be substantially planar or flat.

As shown in FIG. 2, the light emitting diode 10 further emits a section of light 210 that is headed house side or away from the street. This section of light 210 is incident upon an inner refractive surface 40 of the cavity 30 that forms a beam 200 within the optic 100. The refractive surface 40 has an associated optical axis 45. The optical axis 45 can form an angle with the optical axis 25 associated with the light emitting diode 10 itself. The optical axis 45 and the optical axis 25 can form an angle whether they actually intersect or not. The angle can be acute. In some example embodiments, the angle is between about 10 degrees and about 80 degrees, when measured in side view such as provided in FIG. 2. In some example embodiments, the angle is in a range between approximately 20 degrees and approximately 70 degrees. In some example embodiments, the angle is in a range between approximately 30 degrees and approximately 60 degrees, i.e. the angle is within 15 degrees of 45 degrees.

In the illustrated embodiment, the inner refractive surface 40 projects, protrudes, or bulges into the cavity 30, which is typically filled with a gas such as air. In an example embodiment, the refractive surface 40 can be characterized as convex and further as a collimating lens. The term "collimating," as used herein in the context of a lens or other optic, generally refers to a property of causing light to become more parallel that the light would otherwise be in the absence of the collimating lens or optic. Accordingly, a collimating lens may provide a degree of focusing.

The beam 200 propagates or travels through the optic 100 along the optical axis 45 and is incident upon a reflective surface 50 that redirects the beam 200 towards an outer refractive surface 60. The redirected beam 200 exits the optic 100 through the outer refractive surface 60, which further steers the refracted beam 220 street side and can produce a desired level of beam spread. The reflective surface 50 is typically totally internally reflective as a result of the angle of light incidence exceeding the "critical angle" for total internal reflection. The reflective surface 50 is typically an interface between solid, transparent optical material of the optic 100 and a surrounding gaseous medium such as air.

Those of ordinary skill in the art having benefit of this disclosure will appreciate that the term "critical angle," as used herein, generally refers to a parameter for an optical system describing the angle of light incidence above which total internal reflection occurs. The terms "critical angle" and "total internal reflection," as used herein, are believed to conform with terminology commonly recognized in the optics field.

As illustrated in the FIG. 2, the refracted beam 220 (which is formed by the section of light 210 sequentially refracted, reflected, and refracted) and the twice refracted section of light (that is emitted by the street side of the light emitting diode) collectively provide street-side illumination.

In some example embodiments, the optic 100 is a unitary optical element that comprises molded plastic material that is transparent. In some example embodiments, the optic 100 is a seamless unitary optical element. In some example embodiments, the optic 100 is formed of multiple transparent optical elements bonded, fused, glued, or otherwise joined together to form a unitary optical element that is void of air gaps yet made of multiple elements.

FIG. 7 illustrates an example array 800 of optics 100 provided in a sheet form to facilitate coupling multiple optics 100 to a corresponding array of light emitting diodes. Such an array of light emitting diodes would typically be under the illustrated sheet, and thus are not illustrated in FIG. 7. Accordingly, an illumination system can comprise a two-dimensional array of light sources, each comprising the illumination system 5 illustrated in example form in FIG. 1 inter alia. The resulting two-dimensional array of light sources can comprise a light module or light bar, one or more of which can be disposed in a luminaire or other lighting apparatus, for example.

In some example embodiments, the array 800 can be formed of optical grade silicone and may be pliable and/or elastic, for example. In some example embodiments, the array 800 can be formed of an optical plastic such as polymethyl-methacrylate ("PMMA"), polycarbonate, or an appropriate acrylic, to mention a few representative material options without limitation.

Figure 8:
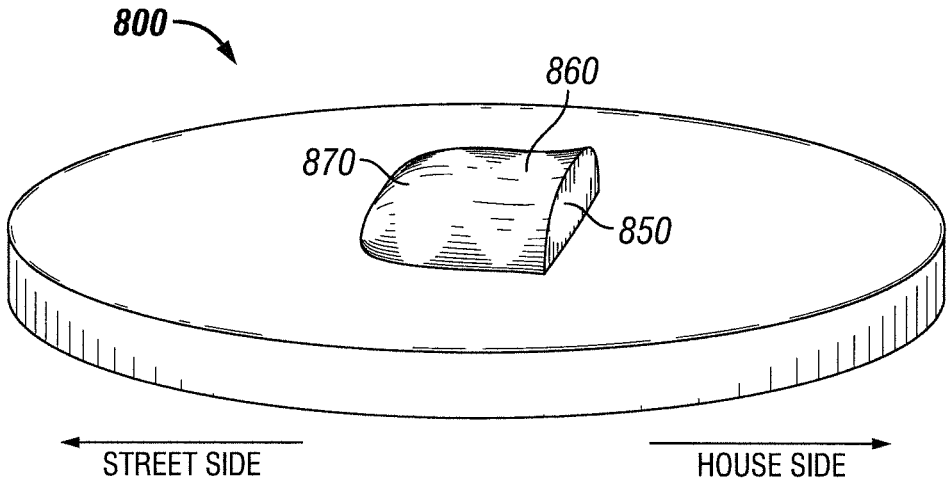
FIG. 8 is a perspective view illustration of another optic for managing light emitted by a light emitting diode according to some example embodiments of the present technology.
Figure 9:
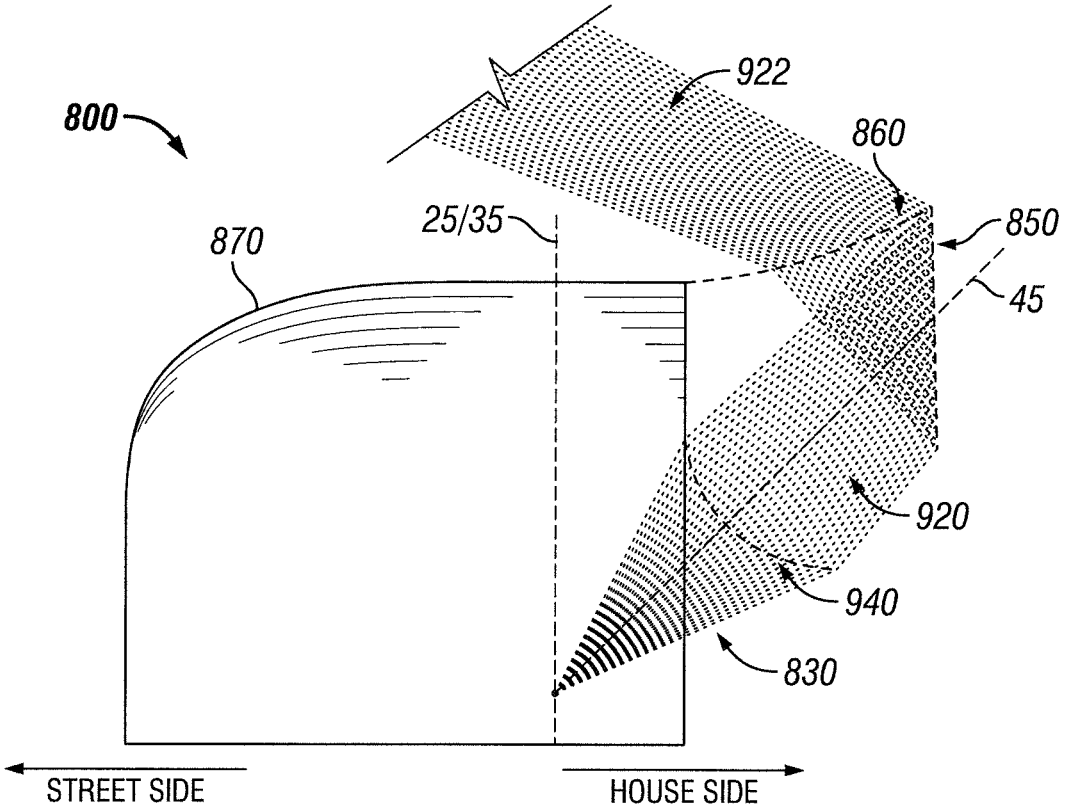
FIG. 9 is an illustration in side view the optic that FIG. 8 illustrates and further illustrates the optic managing rays as could be emitted by an associated light emitting diode according to some example embodiments of the present technology.
Figure 10:
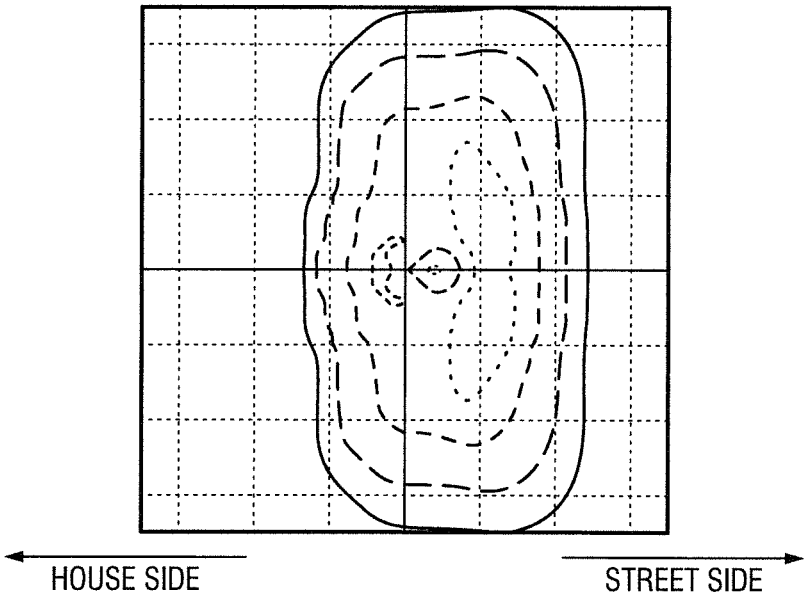
FIG. 10 is an illustration of a representative computer-generated isofootcandle diagram of photometric performance for the optic of FIGS. 8 and 9 as coupled to a light emitting diode, with the lines depicting points of equal illuminance according to some example embodiments of the present technology.

Turning now to FIGS. 8, 9, and 10, these figures describe another example embodiment of the present technology. FIG. 8 illustrates a perspective view of an optic 800 that manages light emitted from a light emitting diode 10. The light emitting diode 10 is not illustrated in FIGS. 8, 9, and 10, but is depicted FIG. 1 and elsewhere as discussed above. Accordingly, the optic 800 can be coupled to a light emitting diode 10 or other light source for managing emitted light to form a light pattern comprising redirected light. FIG. 9 illustrates the optic 800 in side view overlaid with representative ray paths as would begin at a light emitting diode 10.

FIG. 10 illustrates an example diagram of photometric performance, wherein the lines plot common illuminance, analogous to how a contour map plots land elevation. Thus, FIG. 10 describes a computer-generated isofootcandle diagram of example photometric performance for the optic of FIGS. 8 and 9 as coupled to a light emitting diode, with the lines depicting points of equal illuminance.

As shown in FIGS. 8 and 9, the optic 800 comprises an outer refractive surface 870. Light emitted from the light emitting diode 10 in a street direction progresses towards the street through the outer refractive surface 870, which can refract the light to produce desired beam spread. As discussed above, light emitted from a street-side of the light emitting diode 10 can propagate out of the light emitting diode, through an air gap, into the optic 800, and then out of the optic 800 through the outer refractive surface 870. Such an air gap may be filled with air, nitrogen, or other suitable gas.

Light emitted from the house side of the light emitting diode propagates through the cavity 830 and is incident upon an inner refractive surface 940 that forms a beam 920. The beam 920 propagates through the optic and is incident upon a reflective surface 850 of the optic 800. The reflective surface 850 directs the beam 920 out of the optic 800 through the outer refractive surface 860, applying refraction to produce the beam 922 traveling towards the street as desired. In the illustrated embodiment, the outer refractive surface 860 is concave, but may be convex or substantially planar in other embodiments.

The reflective surface 850 can be oriented with respect to the beam 920 to exceed the "critical angle" for total internal reflection, so that the reflective surface 850 totally internally reflects the beam 920. Accordingly, the internally reflective surface 850 can be formed by an interface between air and plastic or other transparent material of the optic 800. Alternatively, the internally reflective surface 850 can comprise a reflective metallic coating.

Figure 11:
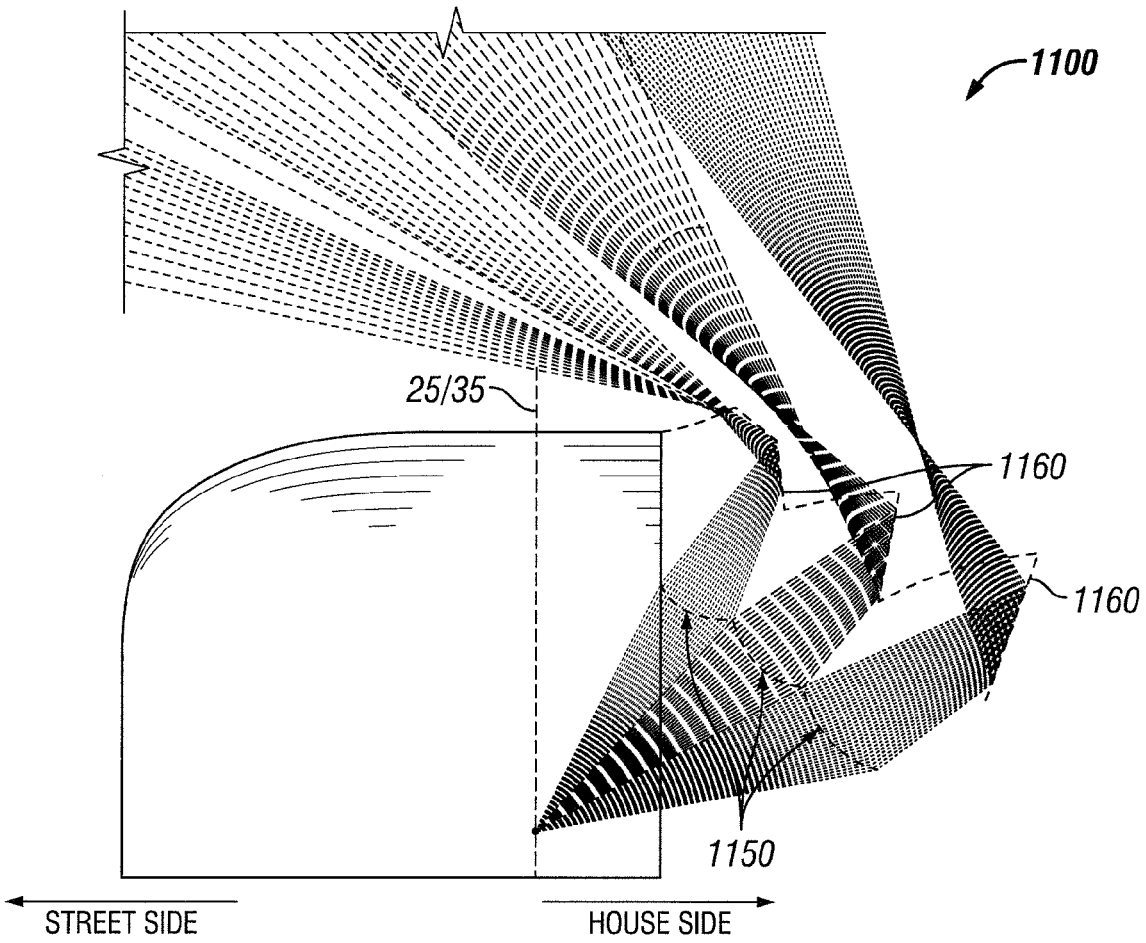
FIG. 11 is an illustration in side view of another optic for managing light emitted by a light emitting diode and further illustrates the optic managing rays as could be emitted by an associated light emitting diode according to some example embodiments of the present technology.
Figure 12:
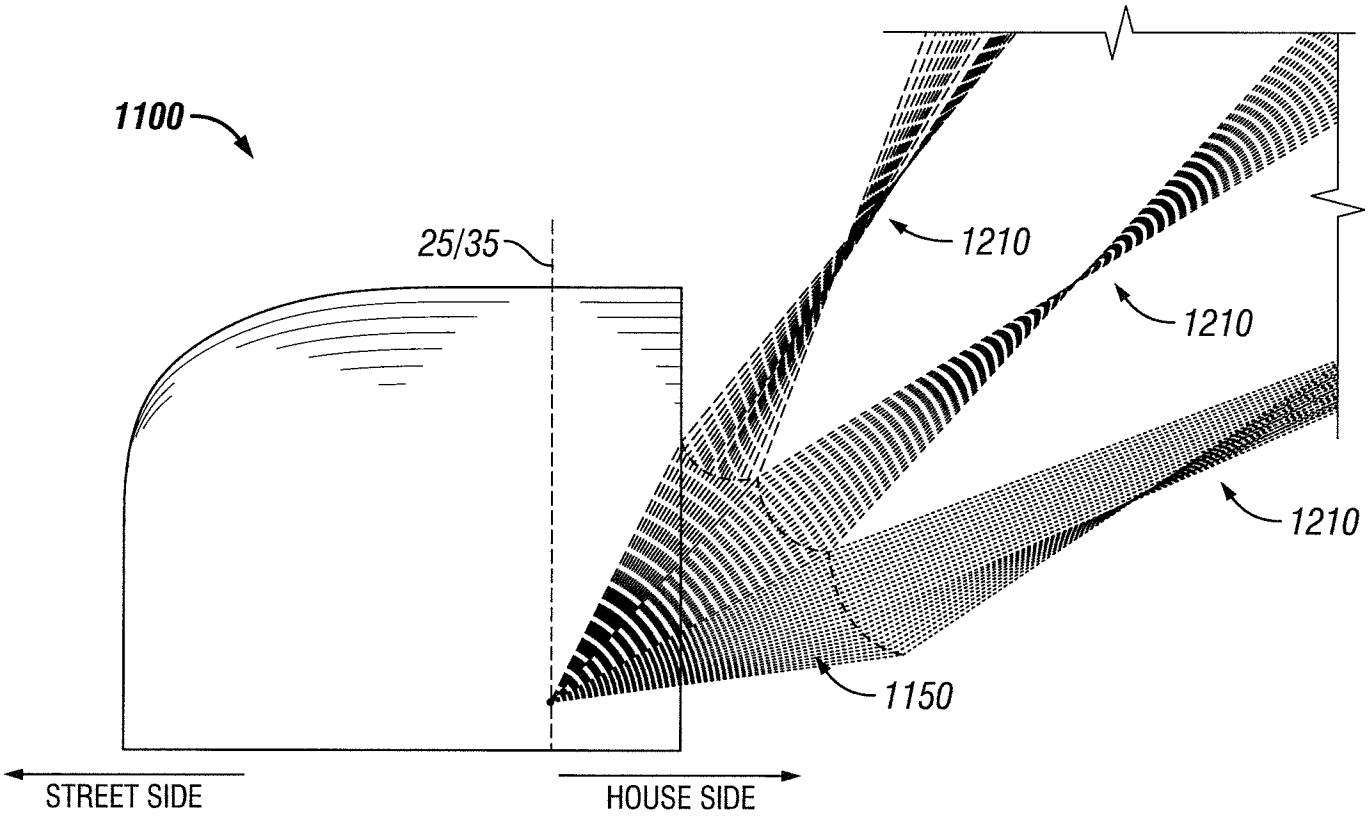
FIG. 12 is an illustration in side view of a representative optical function of inner refractive features of the optic that FIG. 11 illustrates, wherein optical function of exterior features of the optic are ignored in order to promote reader visualization, according to some example embodiments of the present technology.

FIGS. 11 and 12 describe some example embodiments in which an optic 1100 comprises multiple inner refractive surfaces 1150, each forming a separate beam that is individually reflected and then refracted out of the optic 1100. Similar to FIGS. 8, 9, and 10 as discussed above, a light generating element is not shown in FIG. 11 in order to promote reader visualization. In a typical application, the optic 1100 can be coupled to a light emitting diode 10 or other appropriate light source, and the optic 1100 can manage the generated light.

FIG. 12 illustrates the optic 1100 in side view overlaid with representative ray paths as would begin at an example light emitting diode 10 (see light emitting diode 10 illustrated in FIG. 2). In the illustrated embodiment, light emitted in the house side direction encounters the three inner refractive surfaces 1150, each receiving a respective solid angle of emitted light. The three inner refractive surfaces 1150, which can be convex from the illustrated viewing perspective, form three respective beams of light. As illustrated in FIG. 12 and discussed below, the three beams can have different focal lengths 1210.

Three totally internally reflective features 1160 respectively reflect the three beams to increase street-side illumination. The configurations of the totally internally reflective features 1160 avoid occlusion or unwanted distortion of those three redirected beams thereby avoiding uncontrolled incidence or grazing off the outer surface of the optic 1100. In the illustrated example embodiment, two of the three totally internally reflective features 1160 are undercut, and all three jut outward.

FIG. 12 illustrates how the inner refractive surfaces 1150 create beams with different focal lengths 1210, which would be reflected and refracted by the totally internally reflective features 1160 as shown in FIG. 11 in a physical implementation. That is, to convey an example principle of the embodiment of FIG. 11, FIG. 12 illustrates the three inner refractive surfaces 1150 forming three beams, and the beams are depicted as propagating within optical material of the optic 1100 without interacting with any subsequent optical features.

Figure 13A:
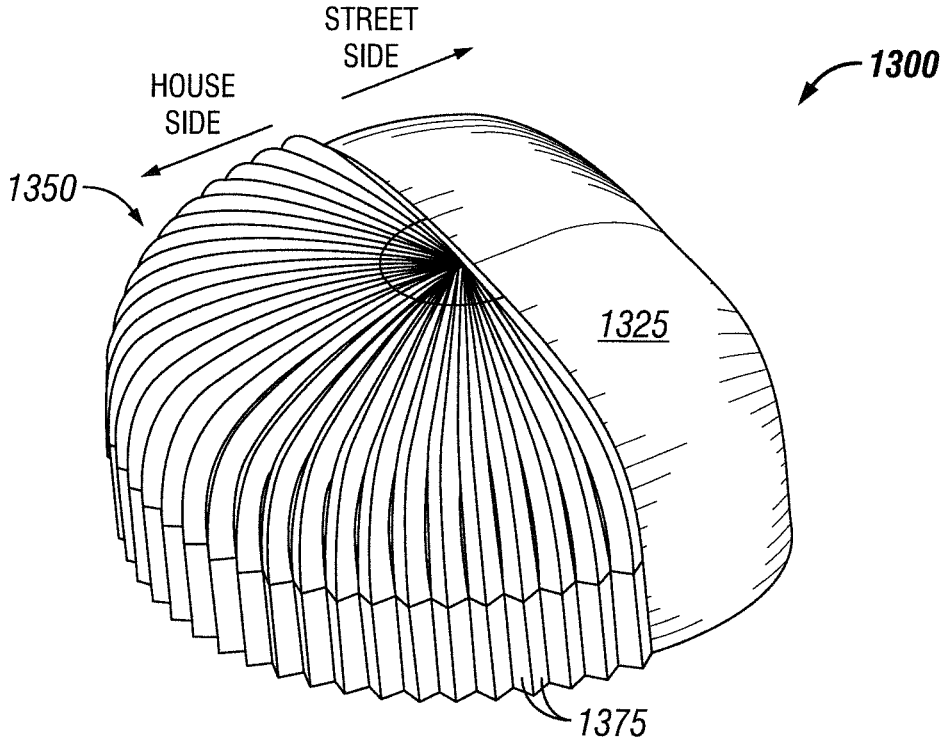
FIGS. 13A and 13B (collectively FIG. 13) are illustrations of an illumination system that comprises a light emitting diode coupled to another optic according to some example embodiments of the present technology.
Figure 13B:
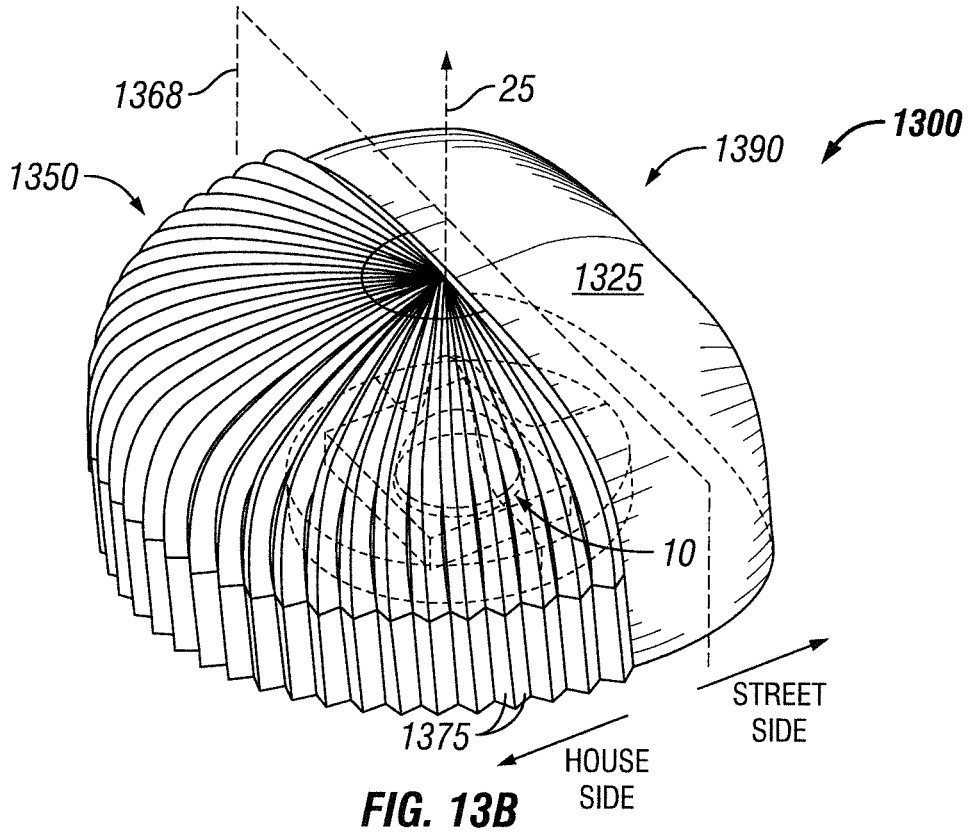

FIGS. 13A and 13B, 14, 15, 16, and 17 describe some example embodiments in which the street side of the optic 1300 is smooth and the house side comprises prismatic grooves 1350, as an example embodiment of a pattern of retroreflectors. As illustrated, a reference plane 1368, containing an optical axis 25, that demarcates the two sides of the optic 1300 and can cut through the dome 20 of the light emitting diode 10 (see FIG. 1 as the dome is not labeled in FIG. 13B to avoid line clutter). FIGS. 13A and 13B are renderings respectively illustrating the optic 1300 as an opaque solid and as a transparent line drawing that shows an example light emitting diode 10 positioned to emit light into the optic 1300.

In the illustrated illumination system 1390, the prismatic grooves 1350 arch over the optic 1300 and the light emitting diode 10. Light incident on the prismatic grooves 1350 is retroreflected back over the light emitting diode 10, resulting in redirection to emerge from the smooth refractive surface 1325 headed in a street-side direction. In an example embodiment, each prismatic groove 1350 comprises a retroreflector. Each prismatic groove 1350 comprises a pair of totally internally reflective surfaces 1375 or facets that collaboratively reflect light back in the general direction from which the light came. In some example embodiments, the totally internally reflective surfaces 1375 are substantially perpendicular to one another. In some example embodiments, the totally internally reflective surfaces 1375 meet to form a corner functioning as a retroreflecting edge of a cube, and may be characterized as a cube edge.

In operation, a light ray is incident on the first surface of the pair of totally internally reflective surfaces 1375. The first surface of the pair of totally internally reflective surfaces 1375 bounces the light to the second surface of the pair of totally internally reflective surfaces 1375. The second surface of the pair of totally internally reflective surfaces 1375 bounces the light backwards, providing retroreflection. Accordingly, in some example embodiments, the pair of totally internally reflective surfaces 1375 can form a two-bounce retroreflector.

Figure 16:
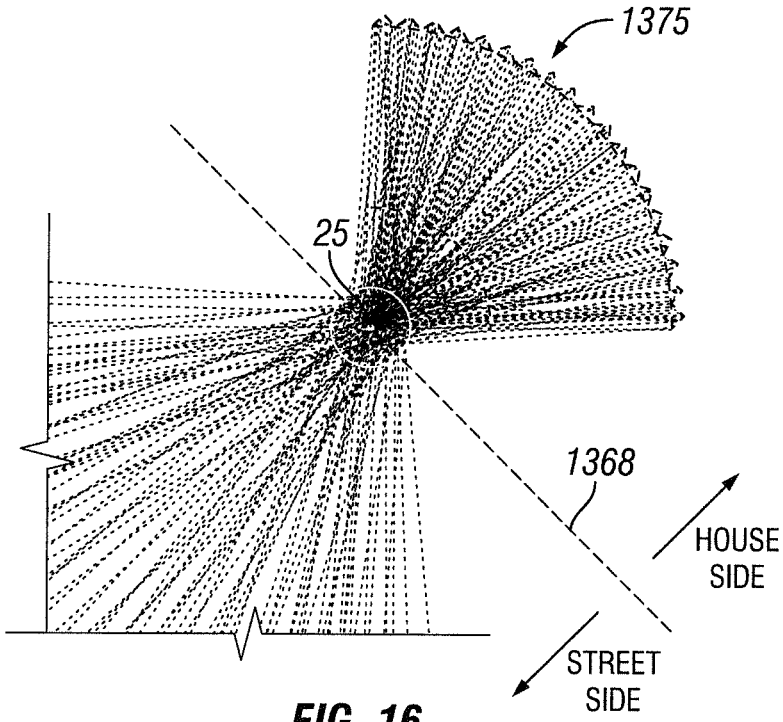
FIG. 16 is a plan view illustration of representative computer-generated ray traces for an embodiment of the illumination system that FIG. 13 illustrates according to some example embodiments of the present technology.

When viewed looking at the light emitting diode 10 straight down the optical axis 25, as shown in FIG. 16, the retroreflected light ray is parallel to the light ray incident on a prismatic groove 1350. Meanwhile, if viewed in a side view taken for example perpendicular to the reference plane 1368, the light ray would have an angle of reflection substantially equal to the angle of incidence. Accordingly, in the illustrated embodiment, the inclination of the light ray can be preserved (albeit reversed), so that the light ray can continue vertically, thereby retroreflecting back over the light emitting diode 10.

Figure 14:
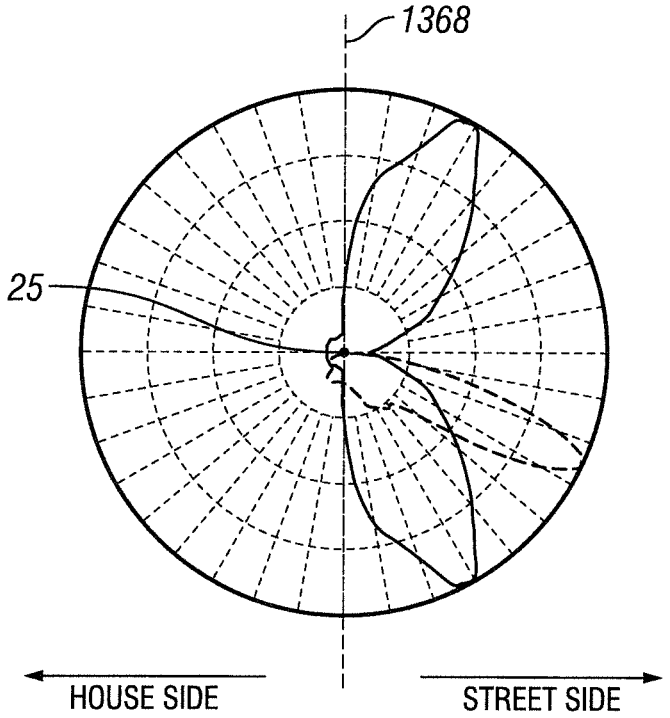
FIG. 14 is an illustration of a representative computer-generated intensity polar plot for the illumination system that FIG. 13 illustrates according to some example embodiments of the present technology.
Figure 15:
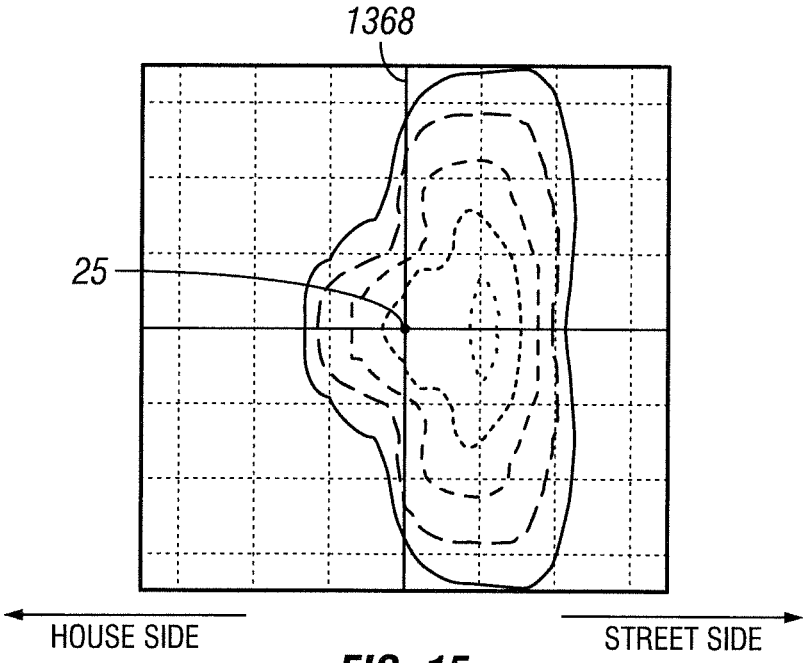
FIG. 15 is an illustration of a representative computer-generated illuminance plot for the illumination system that FIG. 13 illustrates according to some example embodiments of the present technology.

FIG. 14 illustrates an intensity polar plot based on a computer simulation for the illumination system 1390. FIG. 15 illustrates an isofootcandle plot based on a computer simulation for the illumination system 1390. FIGS. 16 and 17 illustrate ray tracing analyses, from plan perspective, specifically looking down the optical axis 25. FIGS. 16 and 17 further illustrate how varying the dimensions of the prismatic grooves 1350/1775 can control the level of light leaking through the prismatic grooves as a result of certain rays being oriented for total internal reflection while other rays are oriented below the critical angle and will be refracted out of the prismatic groove. Increasing groove width, as illustrated in FIG. 17, can increase house-side illumination, for example.

An example process for managing light emitted by a light emitting diode 10 will now be discussed in further detail with reference to FIG. 18, which illustrates a flow chart of an embodiment of such a process in the form of process 1800, entitled "Manage Light."

Certain steps in the processes described herein may naturally precede others for the present technology to function as taught. However, the present technology is not limited to the order of the steps described if such order or sequence does not alter the functionality of the present technology to the level of rendering the technology inoperative or nonsensical. That is, it is recognized that some steps may be performed before or after other steps or in parallel with other steps without departing from the scope and spirit of the present technology.

The following discussion of process 1800 will refer to certain elements illustrated in FIGS. 1, 2, 3, 4, 5A, 5B, 5C, 5D, 5E, 6A, 6B, 6C, 6D, and 6E. However, those of skill in the art will appreciate that various embodiments of process 1800 can function with and/or accommodate a wide range of devices, systems, and hardware (including elements illustrated in other figures as well as elements not expressly illustrated) and can function in a wide range of applications and situations. Accordingly, such referenced elements are examples, are provided without being exhaustive and without limitation, and are among many other supported by the present technology.

Referring now to FIG. 18, at step 1805 of process 1800, the light emitting diode 10 converts electricity into light and emits light. The emitted light and/or the light emitting diode 10 has an associated optical axis 25. A portion of the emitted light is emitted in the street-side direction. Another portion, including the section 210, is emitted in the house-side direction.

At step 1810, the inner refractive surface 80 and the outer refractive surface 70 of the optic 100 transmit and refract the light emitted in the desired, street-side direction. Accordingly, the optic 100 directs light to and illuminates the street.

At step 1815, which typically proceeds substantially in parallel with step 1810, the section of light 210 that is headed house side encounters the inner refractive surface 40 of the optic 100. The inner refractive surface 40 forms a beam 200 propagating within the solid optical material of the optic 100, along the optical axis 45. The optical axis 45 is typically oriented at an acute angle relative to the optical axis 25 and/or with respect to the light emitting diode's substrate (e.g. the flat portion of the LED chip from which the dome 20 projects).

At step 1820, which likewise typically proceeds substantially in parallel with step 1810, the beam 200 encounters the reflective surface 50, which is typically totally internally reflective but may be mirrored with a metal coating as an alternative suitable for certain applications. The reflective surface 50 reverses the beam 200, sending the beam 200 in a street-side direction.

At step 1825, the beam 200 exits the optic 100 heading street side, and may be refracted upon exit. Step 1825 may likewise proceed substantially in parallel with Step 1810.

At step 1830, the optic 100 emits a pattern of light that, as illustrated in FIG. 10, can be biased towards a street. Process 1800 iterates from step 1830, and management of light to provide biased illumination continues.

FIGS. 19-39, which describe additional example embodiments, will now be discussed.

Figure 19:
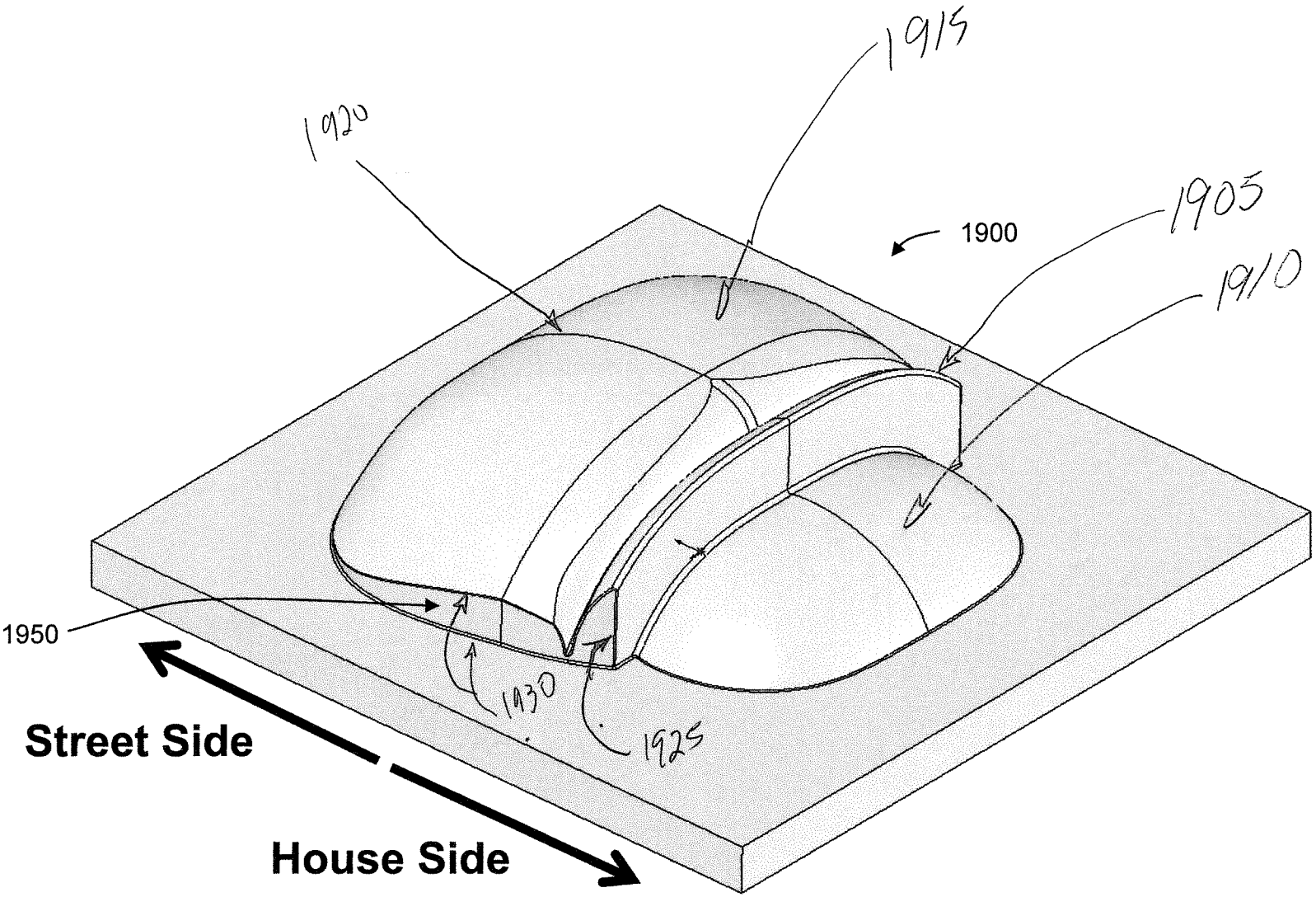
FIG. 19 is a perspective view of an optic for managing light emitted by a light emitting diode according to some example embodiments of the present technology.
Figure 20:
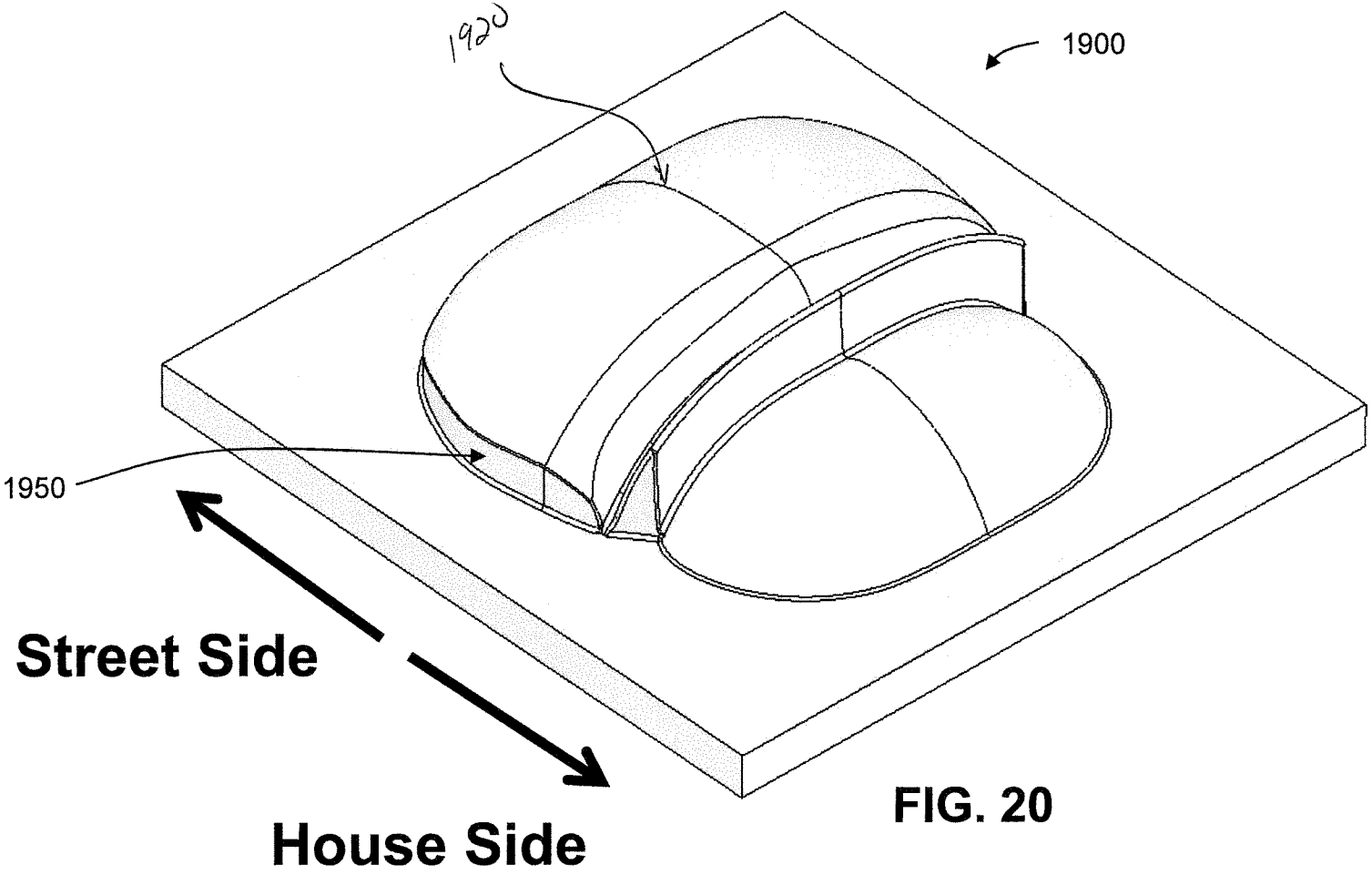
FIG. 20 is another perspective view of the optic of FIG. 19 for managing light emitted by a light emitting diode according to some example embodiments of the present technology.

FIG. 19 illustrates a perspective view of an example optic 1900 for managing light emitted by a light emitting diode in accordance with some embodiments of the present technology. FIG. 20 is another perspective view of the example optic 1900 of FIG. 19 for managing light emitted by a light emitting diode in accordance with some embodiments of the present technology.

Optically inactive edges of the optic 1900 have been truncated, forming a peripheral sideway 1950, thereby reducing volume and material usage of the optic 1900 to facilitate efficient manufacturing via molding or other appropriate process. The peripheral sidewall 1950 extends peripherally to a corner 1925, which may also be viewed as an edge. Laterally, the peripheral sidewall 1950 extends between two corners 1930, which may also be viewed as edges.

In the illustrated embodiment, the exterior surface of the optic 1900 is symmetric with respect to a plane (shown as a line) 1920 running street side to house side. In a typical installation, the plane of symmetry 1920 may be oriented perpendicular to a street, for example.

As will be discussed in further detail below, the exterior surface of the optic 1900 comprises a region 1915 that transmits light that is emitted from a light emitting diode 2100 (hidden in FIG. 19, visible in FIG. 21) in a street side direction. Another region 1910 of the exterior surface of the optic 1900 is internally reflective and reflects incident light towards the backside of the optic 1900 for further processing, which can include sending some incident light street side while other incident light is sent house side. Another region 1905 of the exterior surface of the optic 1900 forms a prism jutting from the optic 1900, and that region 1905 reflects in the street side direction incident light that would otherwise be headed house side.

Figure 21:
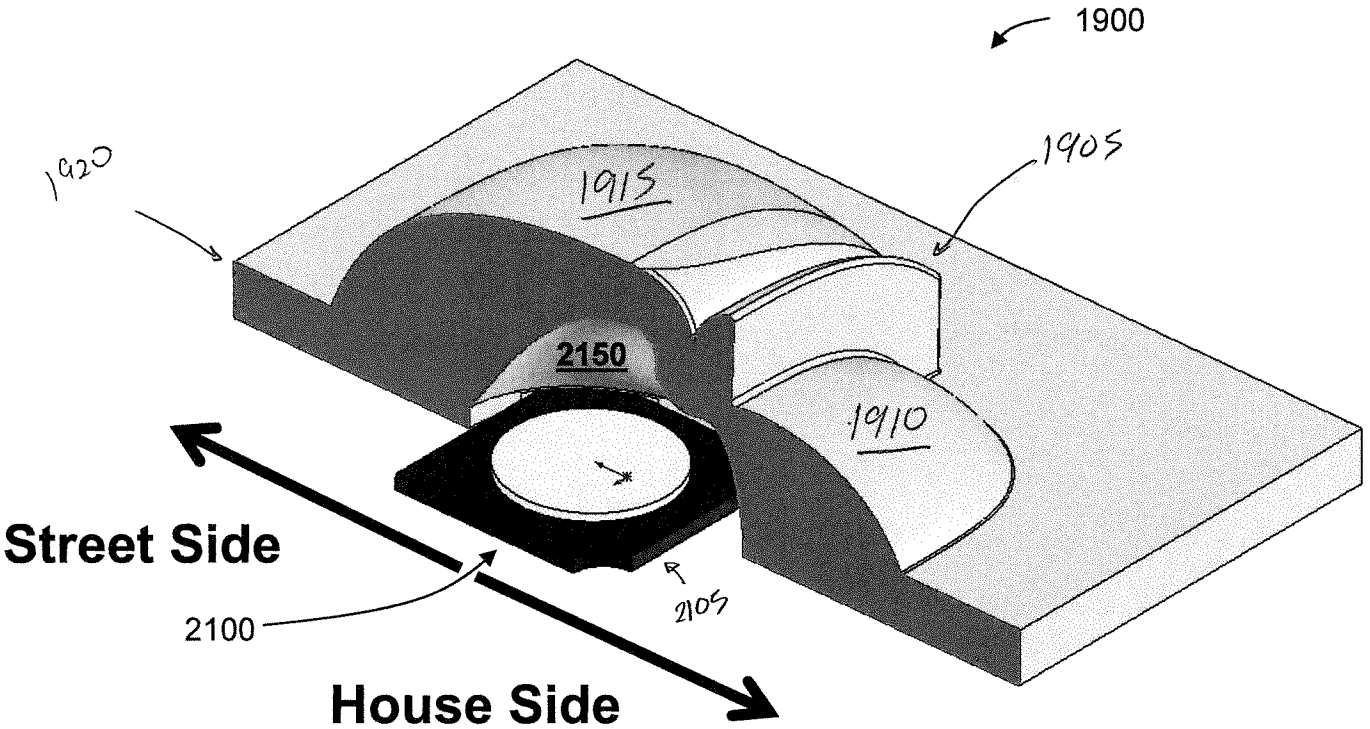
FIG. 21 is a cutaway perspective view of the optic of FIG. 19 for managing light emitted by a light emitting diode according to some example embodiments of the present technology.

FIG. 21 illustrates a cutaway perspective view of the example optic 1900 of FIG. 19 for managing light emitted by a light emitting diode 2100 in accordance with some embodiments of the present technology. The cutaway follows a plane of symmetry 1920 for the optic 1900. In the illustrated embodiment, a light emitting diode 2100 is positioned in a cavity 2150 of the optic 1900 and emits light into the cavity 2150, with a portion of emitted light headed street side and another portion headed house side as initially incident on the optic 1900.

Figure 22A:
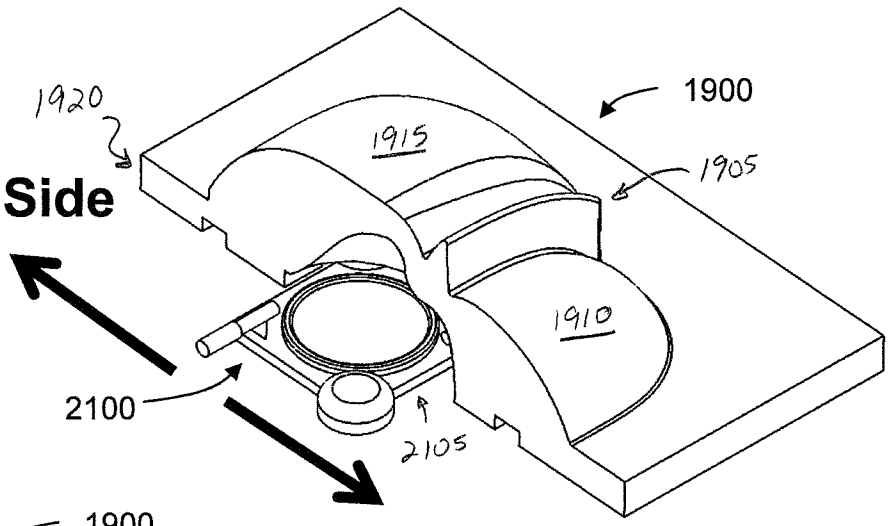
FIGS. 22A and 22B, collectively
Figure 22B:
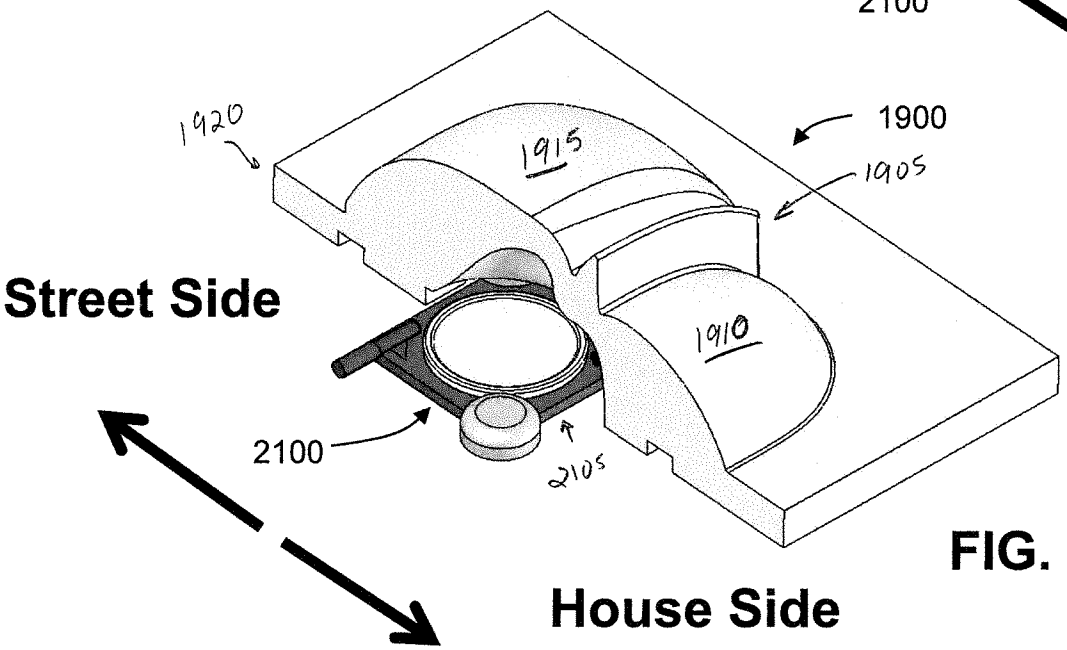

In the example embodiment of FIG. 21, the light emitting diode 2100 comprises a chip-on-board system. The chip-on-board system comprises a circuit board 2105 and one or more light emitting diode chips mounted on the circuit board. In some embodiments, the LED chips are encapsulated so that one body of encapsulant covers multiple chips. Other embodiments may incorporate light emitting diodes that utilize known mounting technologies other than chip-on-board systems. FIGS. 22A and 22B illustrate cutaway perspective views (respectively un-shaded and shaded) of the example optic 1900 of FIG. 19 for managing light emitted by a light emitting diode 2100 in accordance with some embodiments of the present technology.

Figure 23B:
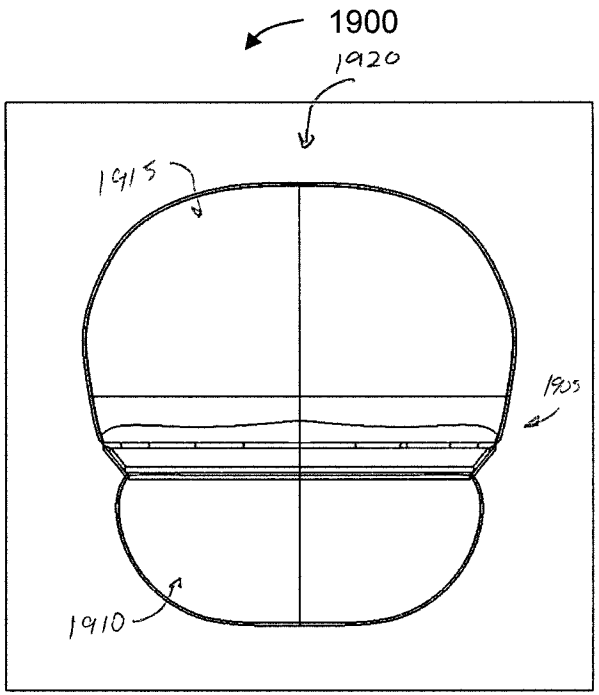
FIGS. 23A and 23B, collectively
Figure 23A:
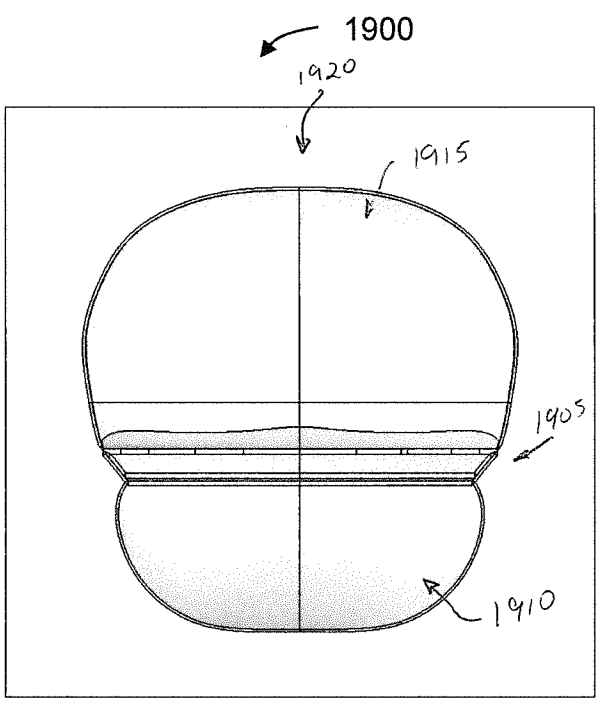

FIGS. 23A and 23B illustrate overhead views (shown shaded and un-shaded respectively) of the example optic 1900 of FIG. 19 for managing light emitted by a light emitting diode 2100 in accordance with some embodiments of the present technology.

Figure 24A:
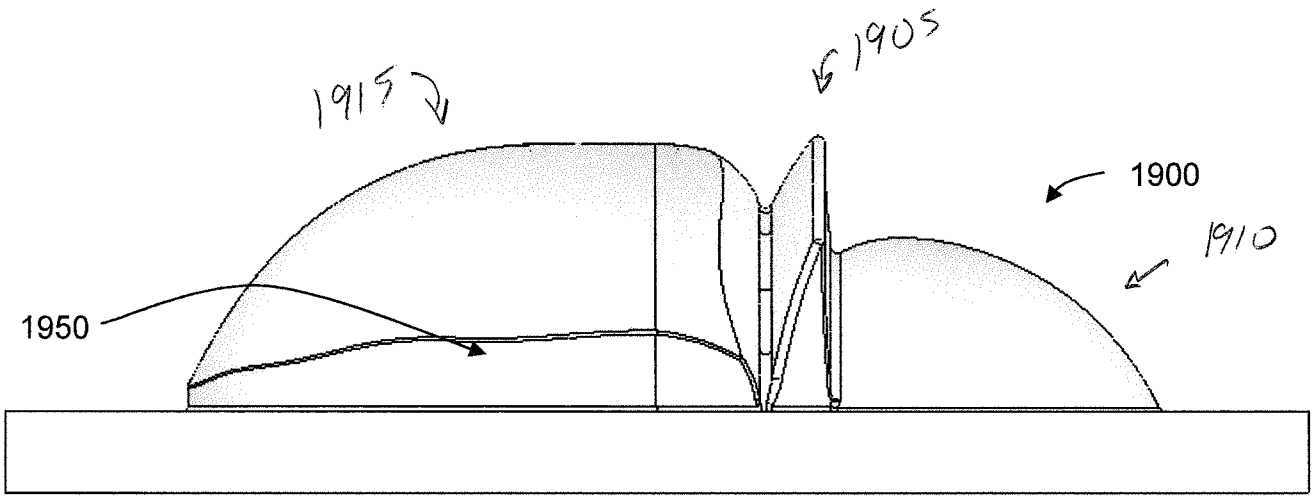
FIGS. 24A and 24B, collectively
Figure 24B:
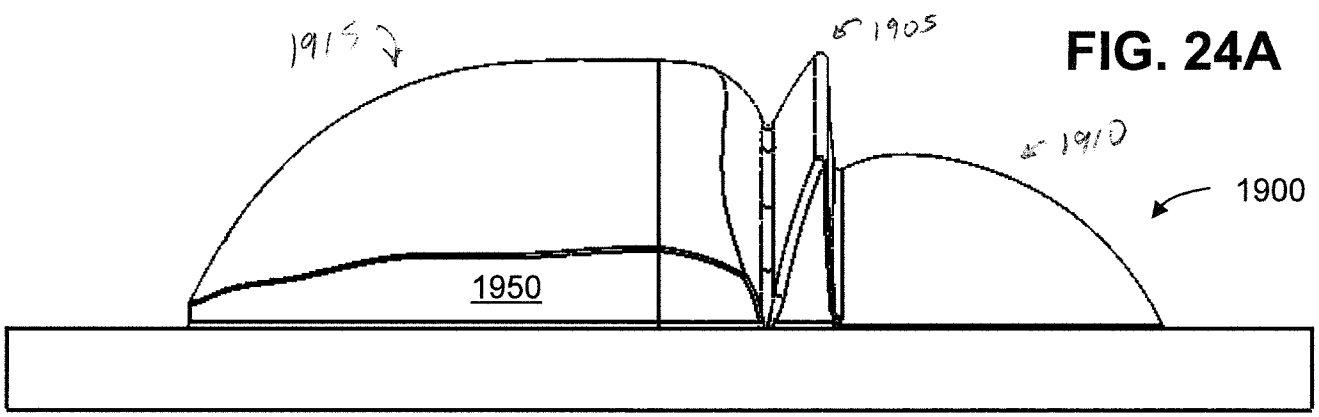

FIGS. 24A and 24B illustrate side views (shown shaded and un-shaded respectively) of the example optic 1900 of FIG. 19 for managing light emitted by a light emitting diode 2100 in accordance with some embodiments of the present technology.

Figure 25:
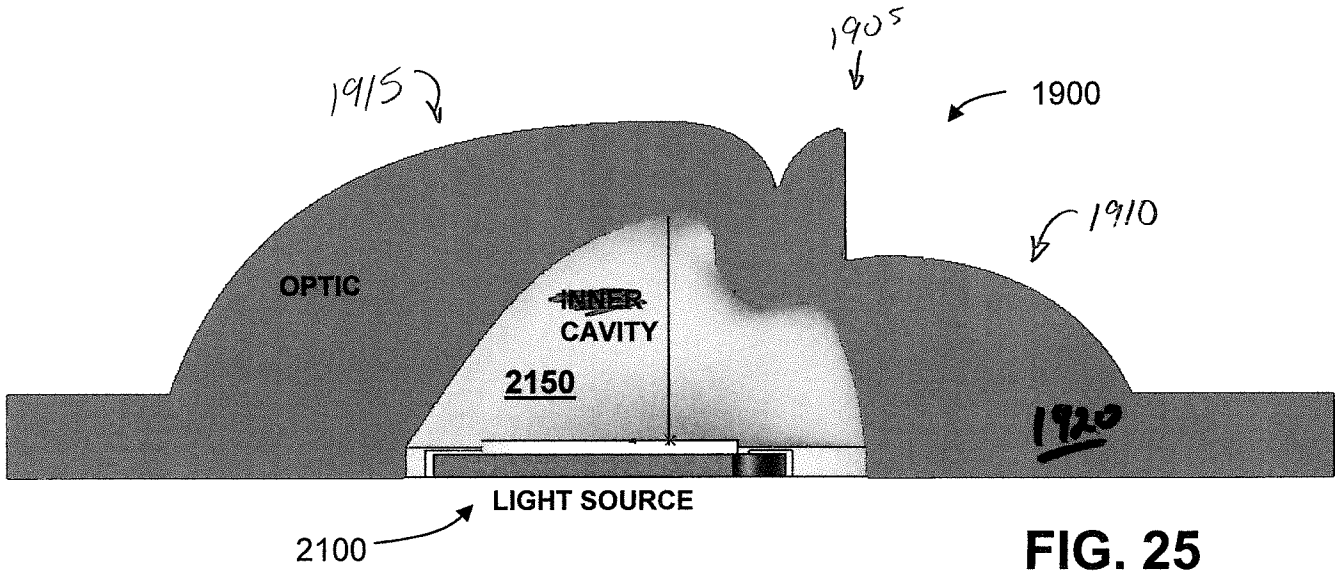
FIG. 25 is a cross sectional view of the optic of FIG. 19 for managing light emitted by a light emitting diode according to some example embodiments of the present technology.
Figure 26:
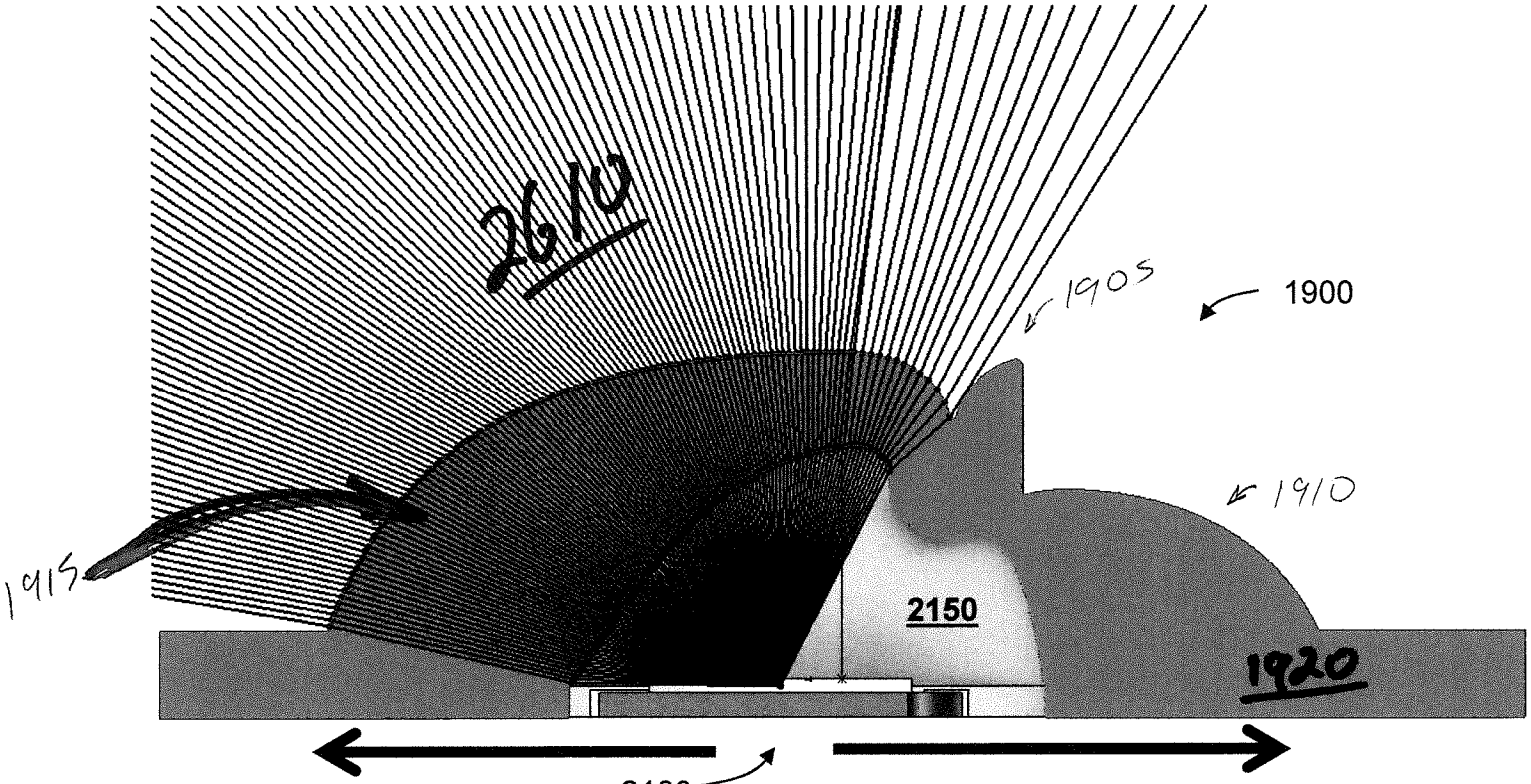
FIG. 26 is a cross sectional view, overlaid with representative ray traces for light emitted in certain directions, of the optic of FIG. 19 for managing light emitted by a light emitting diode according to some example embodiments of the present technology.
Figure 27:
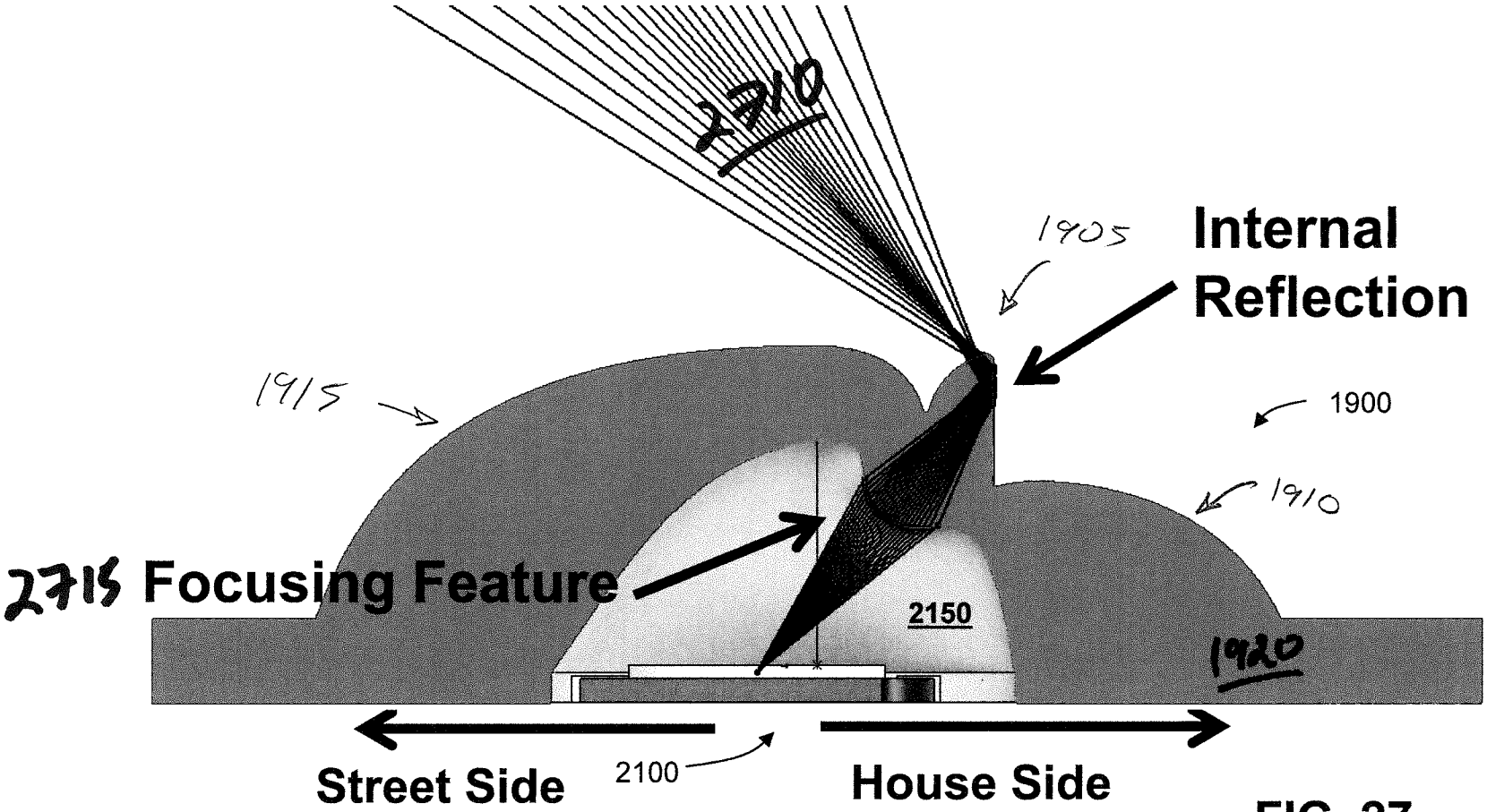
FIG. 27 is a cross sectional view, overlaid with representative ray traces for light emitted in certain directions, of the optic of FIG. 19 for managing light emitted by a light emitting diode according to some example embodiments of the present technology.
Figure 28:
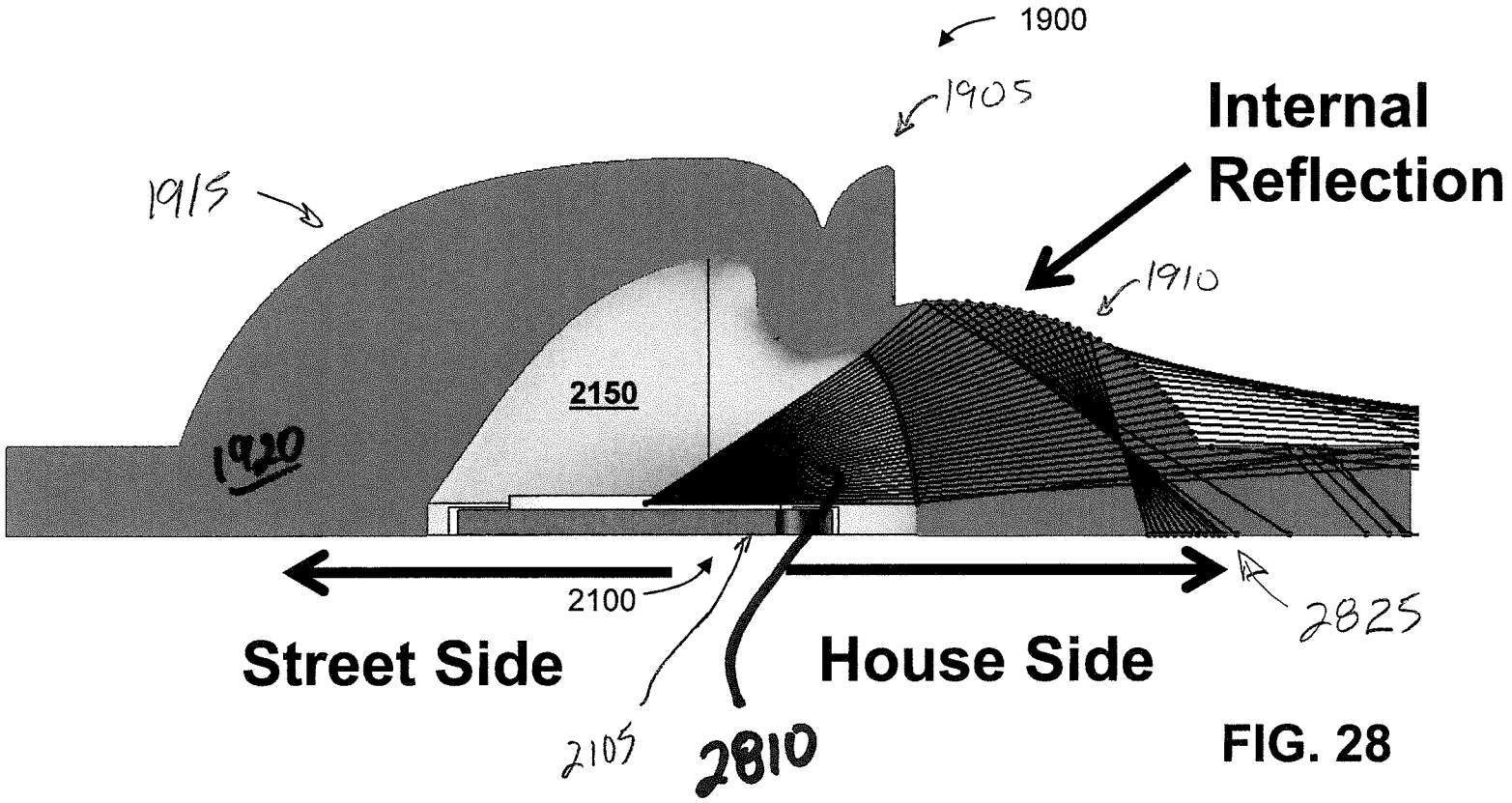
FIG. 28 is a cross sectional view, overlaid with representative ray traces for light emitted in certain directions, of the optic of FIG. 19 for managing light emitted by a light emitting diode according to some example embodiments of the present technology.

FIG. 25 illustrates a cross sectional view (taken along the plane of symmetry 1920) of the example optic 1900 of FIG. 19 for managing light emitted by a light emitting diode 2100 in accordance with some embodiments of the present technology. As discussed above, in the illustrated embodiment, the optic 1900 comprises a cavity 2150 oriented to receive light emitted by the light emitting diode 2100. As illustrated in FIGS. 26, 27, and 28 and discussed below, the optic 1900 can process and direct the emitted light according to direction of the emitted light, resulting in biasing the overall pattern in a street side direction.

FIG. 26 illustrates the cross sectional view of FIG. 25, overlaid with representative ray traces 2610 for light emitted in certain directions, of the example optic 1900 of FIG. 19 for managing light emitted by a light emitting diode 1900 in accordance with some embodiments of the present technology. In the embodiment of FIG. 26, a portion of rays emanate from the light emitting diode 2100 in a street side direction, and those rays generally continue propagating street side as they transmit through and exit the optic 1900.

FIG. 27 illustrates the cross sectional view of FIG. 25, overlaid with representative ray traces 2710 for light emitted in certain directions, of the example optic 1900 of FIG. 19 for managing light emitted by a light emitting diode 2100 in accordance with some embodiments of the present technology. In the embodiment of FIG. 27, a portion of rays emanate from the light emitting diode 2100 in a house side direction, and are focused by a focusing feature 2715 towards a region 1905 of the exterior surface of the optic 1905 that forms a prism. In the illustrated embodiment, the focusing feature 2715 comprises a convex lens that uses refraction for focusing. As a result of such focusing, the feature 2715 can implement imaging or collimation, for example. The region 1905 comprises an internally reflective surface that redirects incident rays in the street side direction, typically via total internal reflection but alternatively via a reflective coating such as aluminum or other appropriate material.

FIG. 28 illustrates the cross sectional view of FIG. 25, overlaid with representative ray traces 2810 for light emitted in certain directions, of the example optic 1900 of FIG. 19 for managing light emitted by a light emitting diode 2100 in accordance with some embodiments of the present technology. In the embodiment of FIG. 28, a portion of the rays emanate from the light emitting diode 2100 in a house side direction and are incident on a region 1910 of the exterior surface of the optic 1900 that is internally reflective. In the illustrated embodiment, the region 1910 utilizes total internal reflection so that the region 1910 internally reflects or transmits light according to angle of incidence.

As illustrated, the light emitting diode 2100 illuminates a portion of the region 1910 with light oriented at angles that support total internal reflection and another portion of the region 1910 with light oriented at angles that are transmitted without total internal reflection. Accordingly, part of the region 1910 is illuminated with light at the so called "critical angle" where a transition between total internal reflection and refractive transmission occurs.

In the illustrated embodiment, internal reflection occurring at the region 1910 directs the incident rays towards horizontal and/or towards the backside 2825 of the optic 1900, which may further be characterized as the base, underside, or rear of the optic 1900. The backside 2825 of the optic 1900 recycles or returns incident light into the optic 1900 where the light can radiate diffusely as an alternative to directionally house side. Accordingly, the backside 2825 of the optic 1900 can send street side a portion of the incident light that is received via internal reflection from the region 1910.

Figure 29:
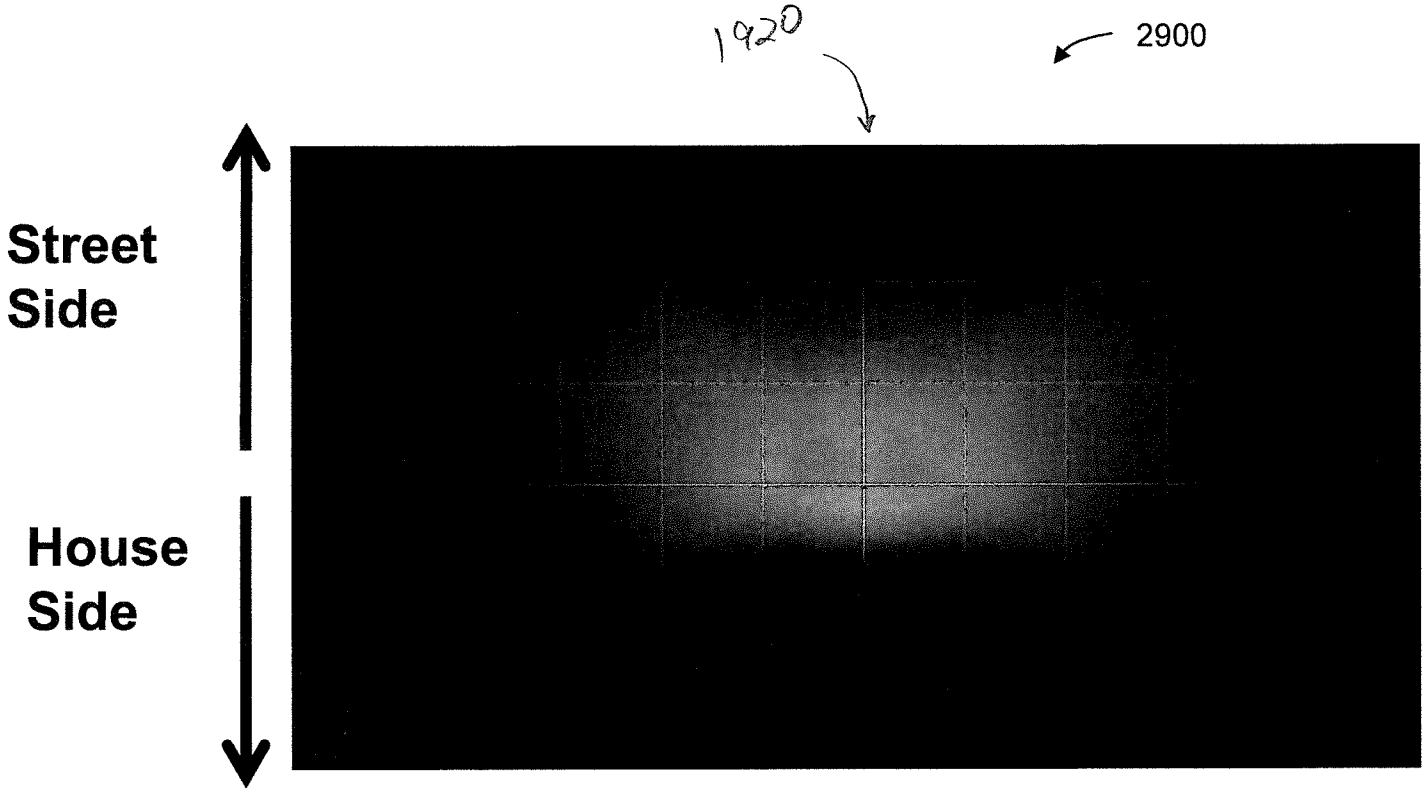
FIG. 29 is a simulated illumination pattern for the optic of FIG. 19 for managing light emitted by a light emitting diode according to some example embodiments of the present technology.

FIG. 29 illustrates a simulated illumination pattern 2900 for the example optic 1900 of FIG. 19 for managing light emitted by a light emitting diode 2100 in accordance with some embodiments of the present technology. As illustrated, the illumination pattern 2900 is biased street side relative to house side. In the illustrated embodiment, the illumination pattern 2900 is further symmetrical about a line 1920 that corresponds with the plane of symmetry 1920 illustrated and discussed above with respect to FIGS. 19-28 inter alia.

Figure 30:
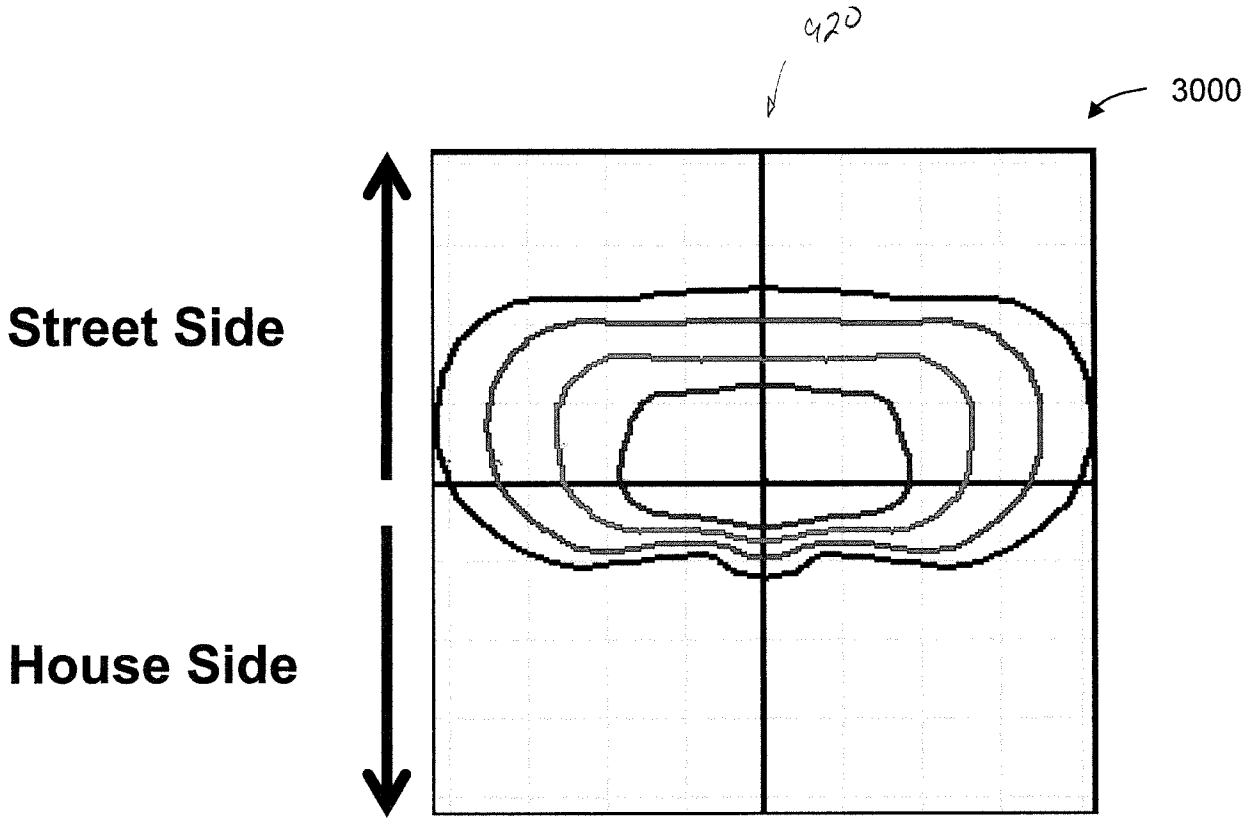
FIG. 30 is a simulated light level contour plot for the optic of FIG. 19 for managing light emitted by a light emitting diode according to some example embodiments of the present technology.

FIG. 30 illustrates a simulated light level contour plot 3000 for the example optic 1900 of FIG. 19 for managing light emitted by a light emitting diode 2100 in accordance with some embodiments of the present technology. More specifically, FIG. 30 shows representative light level contours for the illumination pattern 2900 of FIG. 29. Accordingly, the light level contours are likewise biased street side relative to house side. Additionally, in the illustrated example embodiment, the light level contour plot 3000 is likewise symmetrical about the line 1920.

Figure 31:
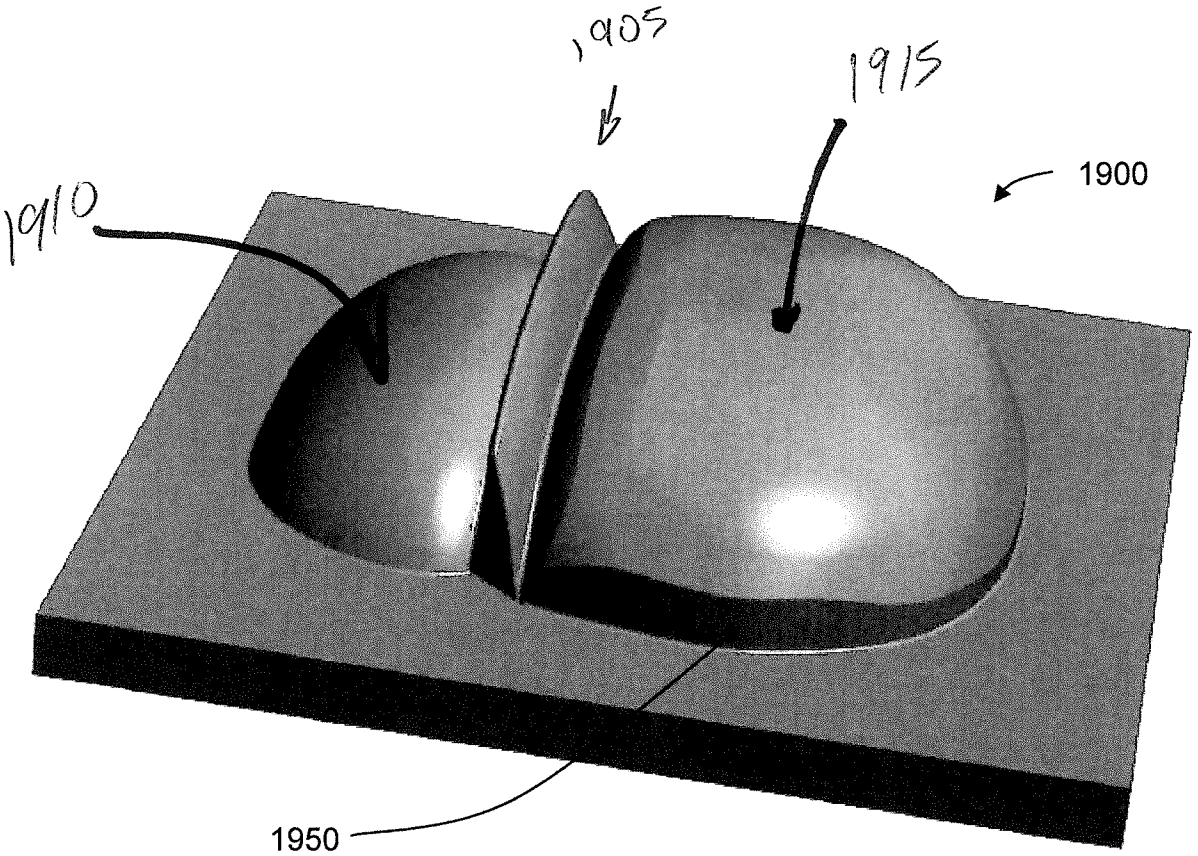
FIG. 31 is a rendered perspective view of the exterior of the optic of FIG. 19 for managing light emitted by a light emitting diode according to some example embodiments of the present technology.
Figure 32B:
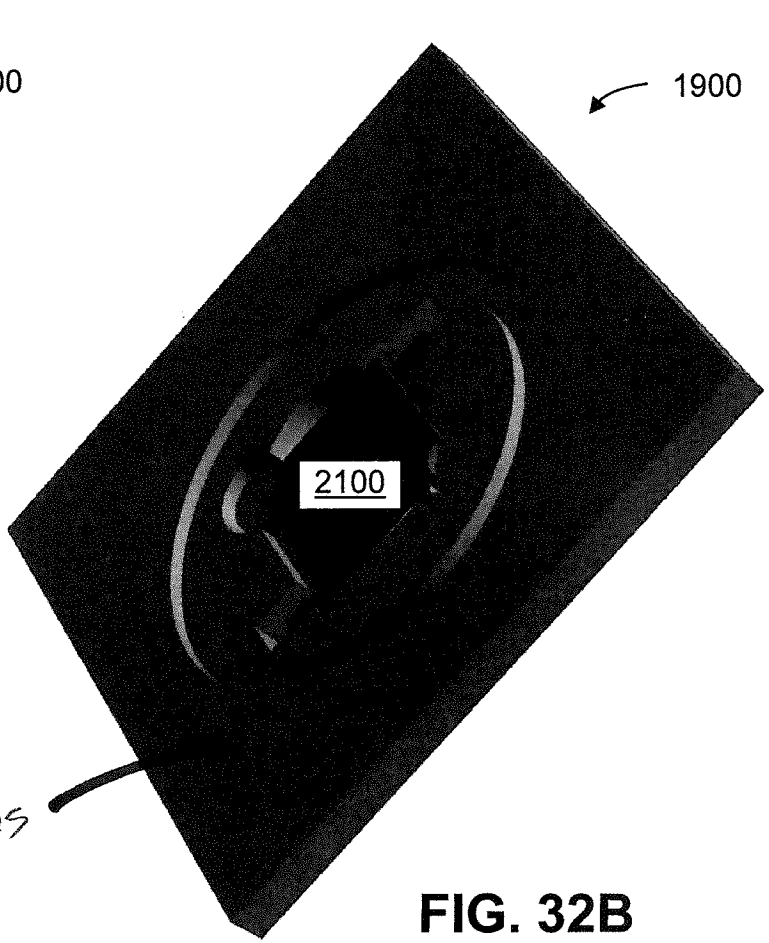
FIGS. 32A and 32B, collectively
Figure 32A:
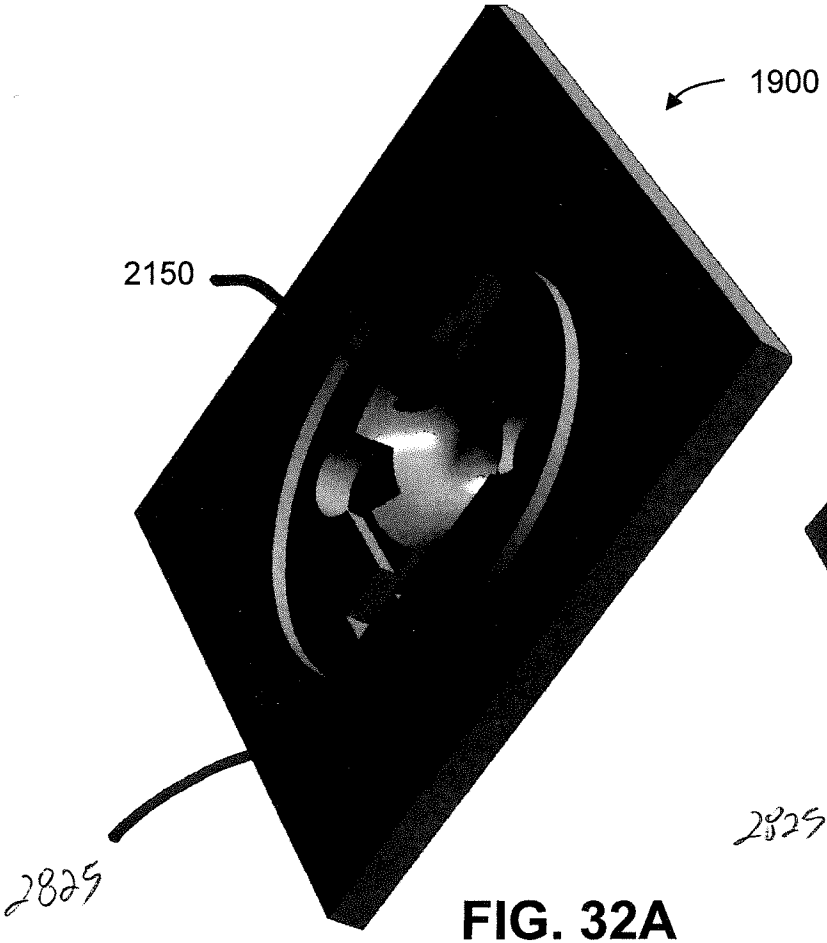

FIG. 31 illustrates a rendered perspective view of the exterior of the example optic 1900 of FIG. 19 for managing light emitted by a light emitting diode 2100 in accordance with some embodiments of the present technology. FIGS. 32A and 32B illustrate rendered perspective views of the underside of the example optic 1900 of FIG. 19, for managing light emitted by a light emitting diode 2100 in accordance with some embodiments of the present technology. FIG. 32A shows the underside and base of the optic 1900 without an accompanying light emitting diode 2100. FIG. 32B shows the underside and base with the accompanying light emitting diode 2100 forming an example embodiment of an illumination system.

Figure 33B:
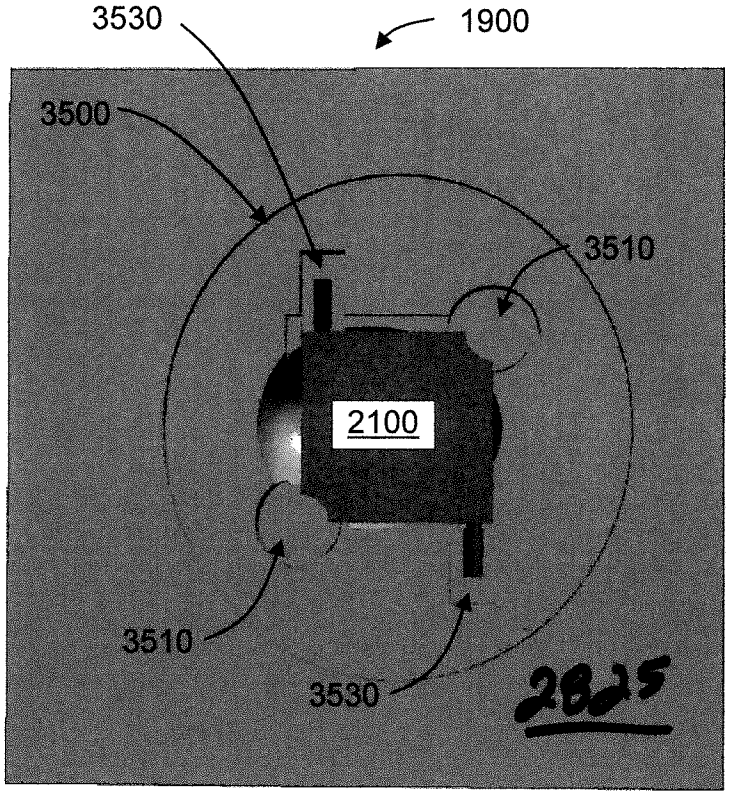
FIGS. 33A and 33B, collectively
Figure 33A:
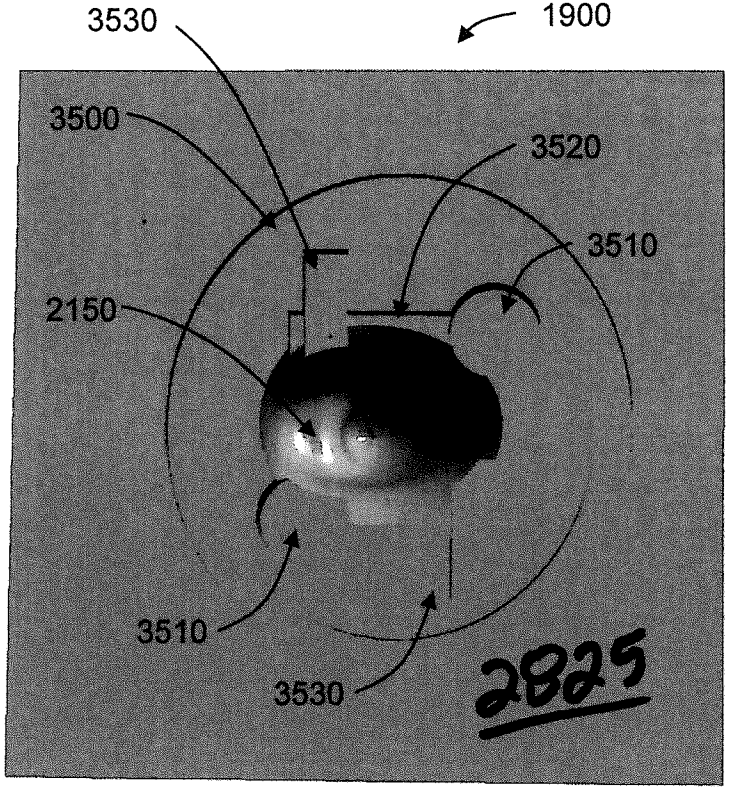

FIGS. 33A and 33B illustrate rendered views of the underside (including the backside 2825) of the example optic 1900 of FIG. 19, for managing light emitted by a light emitting diode 2100 in accordance with some embodiments of the present technology. FIG. 33A shows the underside of the optic 1900 without an accompanying light emitting diode 2100, while FIG. 33B shows the underside with the accompanying light emitting diode 2100. FIGS. 33A and 33B further illustrate a recess 3520 adjacent optically active portions of the cavity 2150 that forms a receptacle for the light emitting diode 2100 in the chip-on-board format. In the illustrated embodiment, the recess 3520 forms a receptacle having an irregular outline that matches and is fitted to the outline of the light emitting diode 2100, which comprises a chip-on-board system as discussed above. The resulting receptacle includes channels 3530 for electrical leads and areas 3510 for fasteners. A gasket seats in a circumferential groove 3500 to provide environmental protection, for example against moisture.

Figure 34A:
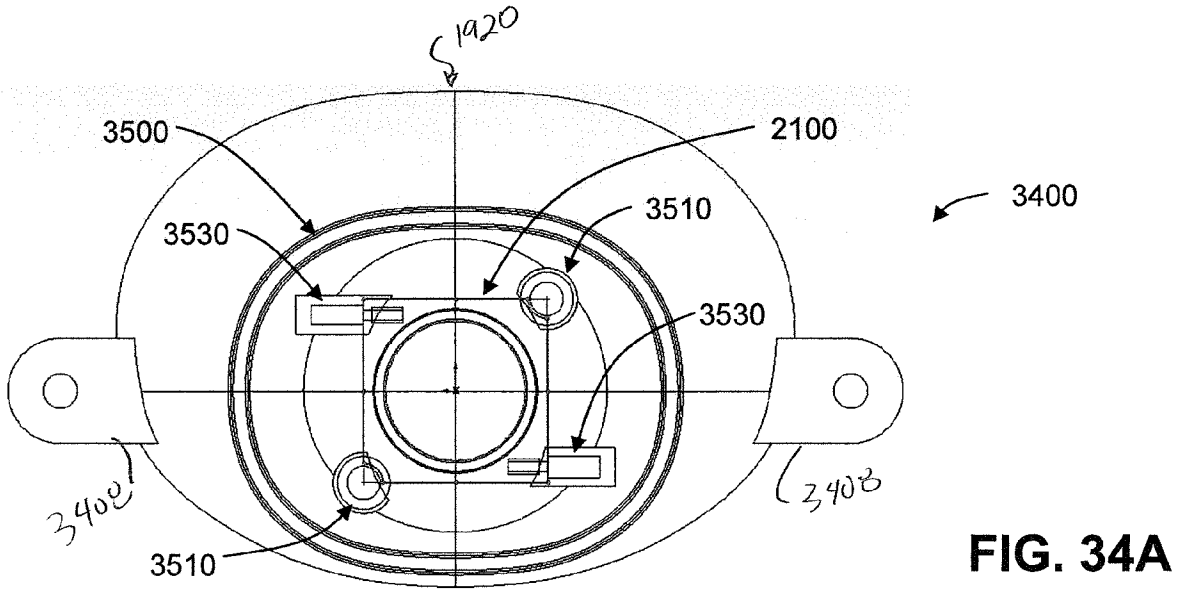
FIGS. 34A and 34B, collectively
Figure 34B:
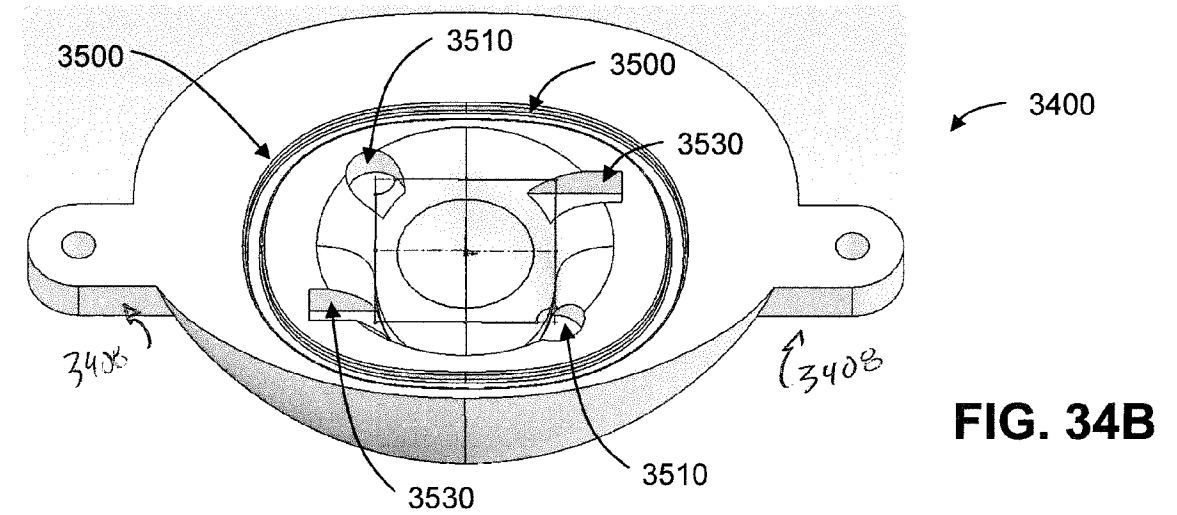

FIGS. 34A and 34B illustrate further views of the underside of an example optic 3400 for managing light emitted by a light emitting diode 2100 in accordance with some embodiments of the present technology. The figures describe another representative embodiment that comprises features analogous to those discussed above with reference to FIG. 33, inter alia. The embodiment of FIGS. 34A and 34B comprises wings 3408 with holes sized for screws to support fastener-based mounting.

Figure 35B:
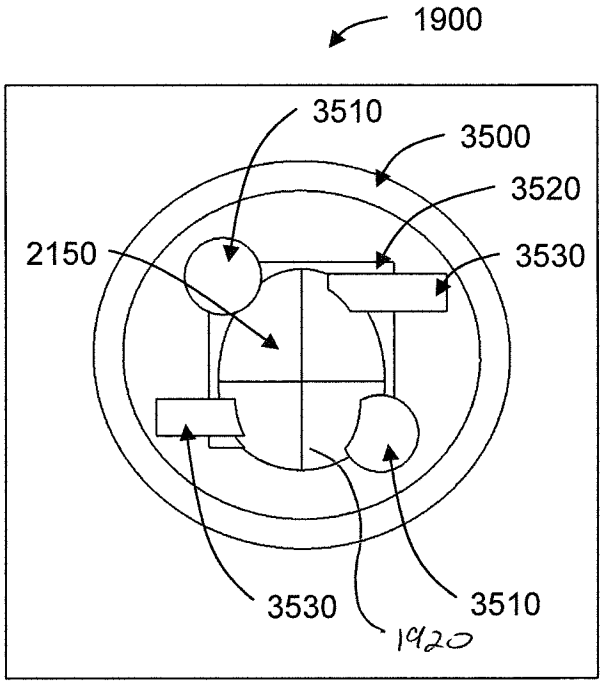
FIGS. 35A and 35B, collectively
Figure 35A:
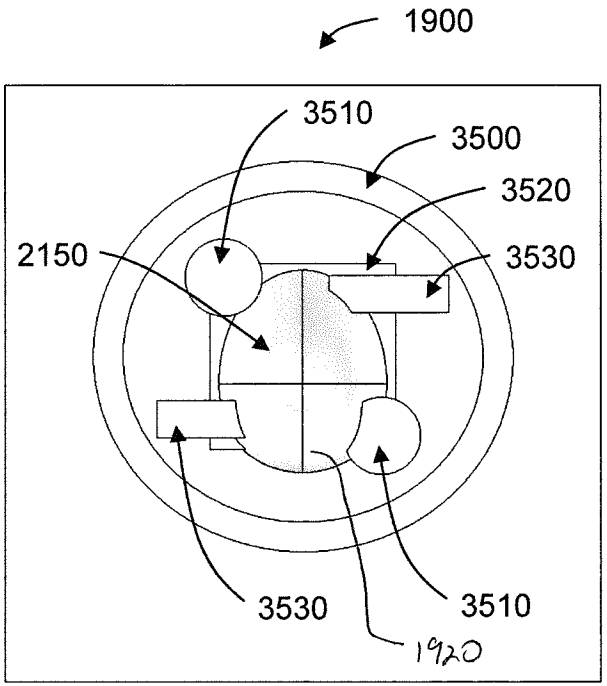

FIGS. 35A and 35B illustrate bottom views of the example optic 1900 of FIG. 19, respectively showing the optic's cavity 2150 shaded and un-shaded, for managing light emitted by a light emitting diode 2100 in accordance with some embodiments of the present technology. As will be discussed further below with reference to FIG. 39, the example cavity 2150 has an egg-shaped outline and may be further characterized as having an elongated or oblong footprint. As shown in FIG. 39, the outline is taken perpendicular to the direction in which the light emitting diode 2100 is pointed or to the axis of the light emitting diode. The illustrated egg-shaped outline is an oval form with one end larger than the other. In the illustrated embodiment, the egg-shaped outline is two dimensional and is symmetrical in one of those two dimensions and is asymmetrical in the other of those two dimensions.

Figure 36B:
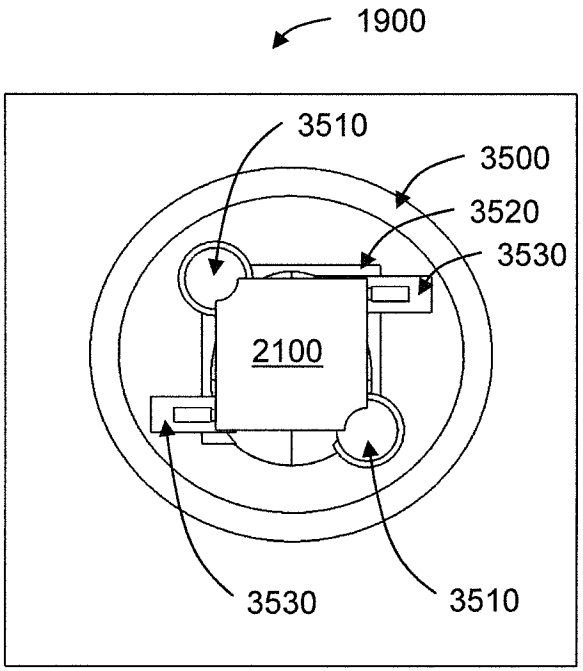
FIGS. 36A and 36B, collectively
Figure 36A:
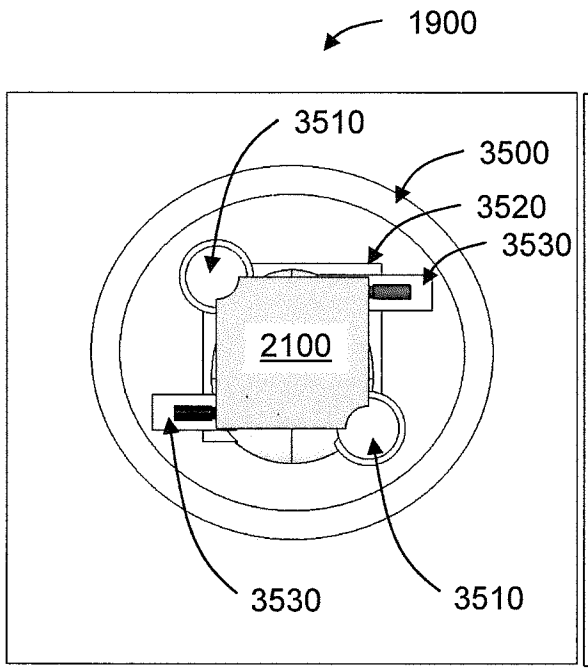

FIGS. 36A and 36B illustrate bottom views of the example optic 1900 of FIG. 19 with an accompanying light emitting diode 2100, showing the light emitting diode 2100 shaded and un-shaded respectively, in accordance with some embodiments of the present technology. As discussed above, in the illustrated example embodiment, the light emitting diode 2100 comprises a substrate in the form of a circuit board with one or more light emitting diode chips mounted thereto, and the optic 1900 comprises an irregularly shaped receptacle in which the light emitting diode is disposed.

Figure 37B:
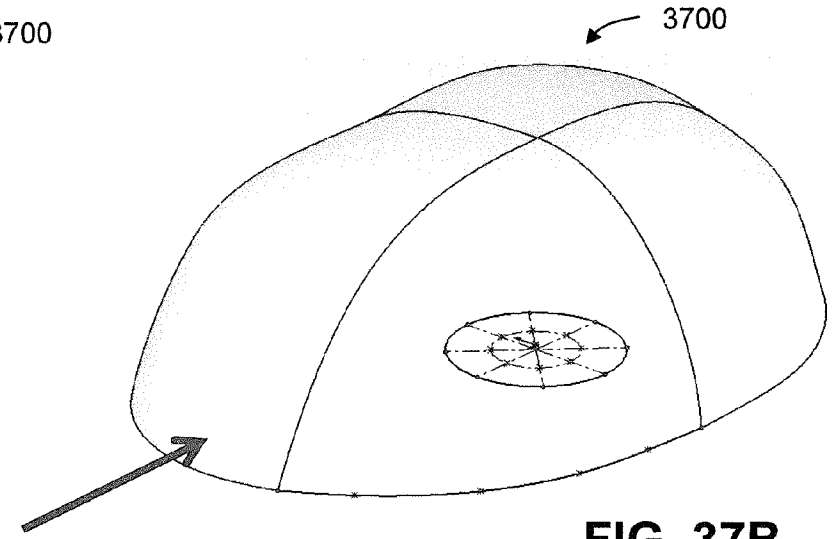
FIGS. 37A, 37B, 37C, and 37D, collectively
Figure 37D:
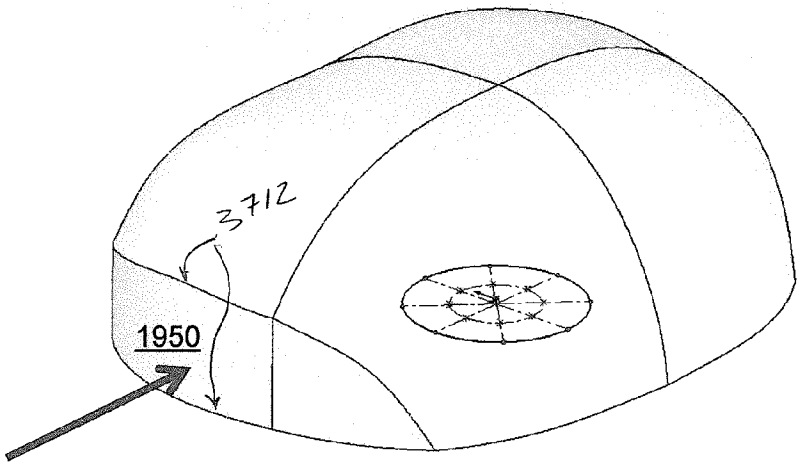
Figure 37A:
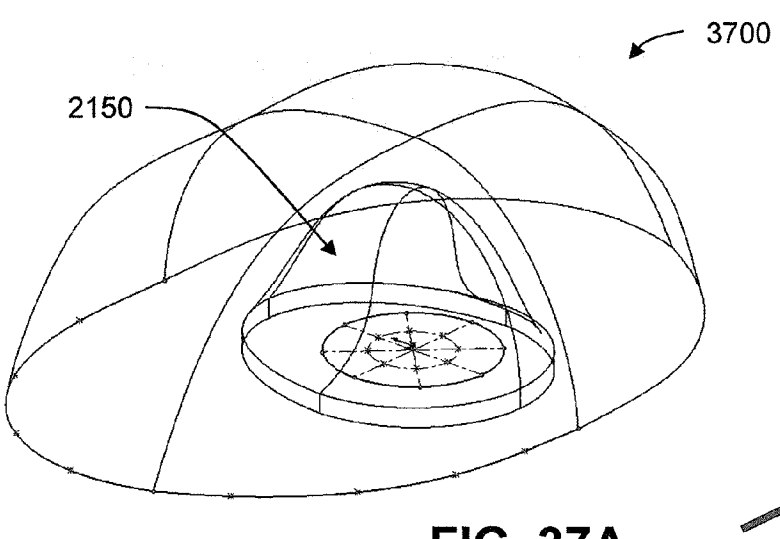
Figure 37C:
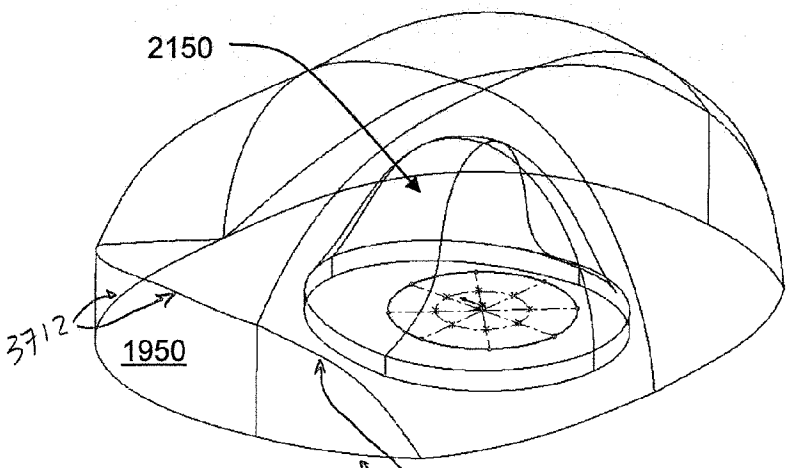

FIGS. 37A, 37B, 37C, and 37D illustrate views of an example optic 3700 for managing light emitted by a light emitting diode 2100 in accordance with some embodiments of the present technology. FIGS. 37A and 37B respectively illustrate the optic 3700 in clear form (wire frame) and as opaque showing the optic 3700 prior to eliminating optically inactive portions of optical material to promote manufacturing efficiency. FIGS. 37C and 37D respectively show the optic 3750 in clear form (wire frame) and as opaque after eliminating optically inactive portions of optical material to promote manufacturing efficiency. As discussed above, eliminating such optical material can beneficially truncate the optic 3750 in a manner that forms a peripheral sidewall 1950 and facilitates efficient molding fabrication, offering improvement in manufacturing economics and speed. As best shown in FIG. 37, the illustrated embodiment of the peripheral sidewall 1950 has a corner or edge that extends fully around the peripheral sidewall 1950, defining a perimeter or boundary of the sidewall 1950.

Figure 38A:
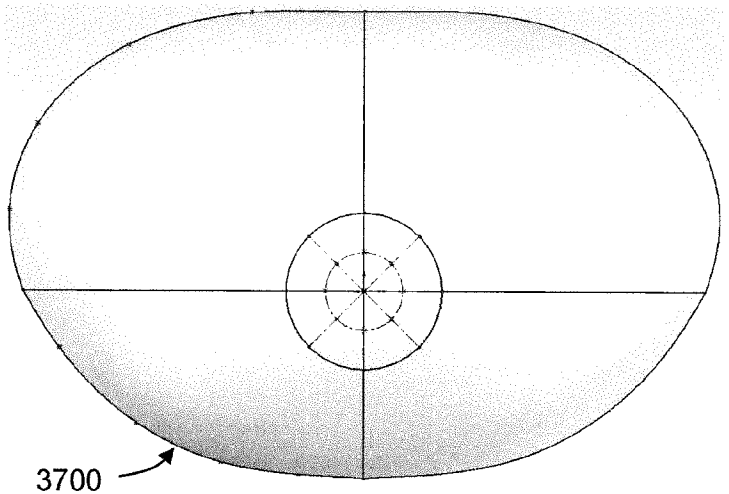
FIGS. 38A, 38B, 38C, and 38D, collectively
Figure 38B:
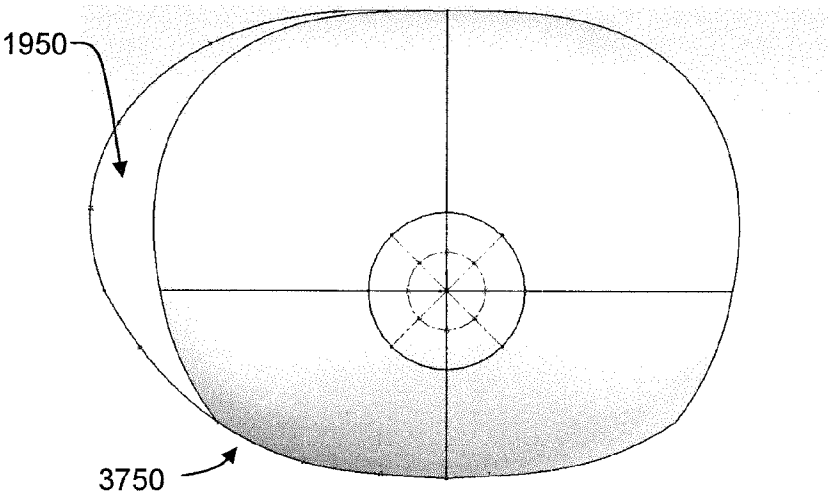
Figure 38C:
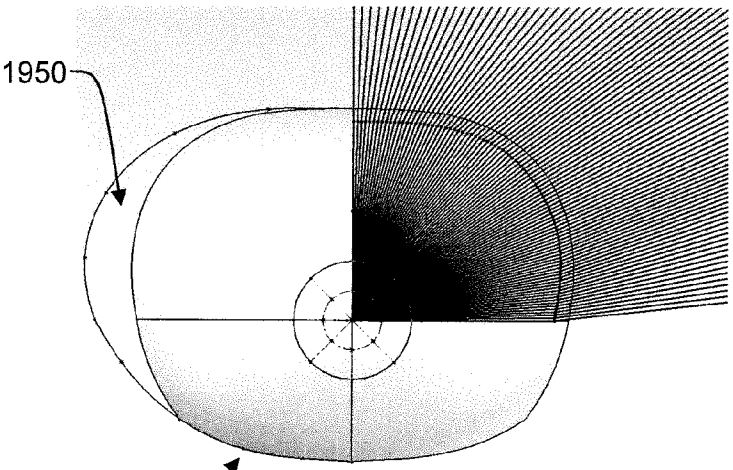
Figure 38D:
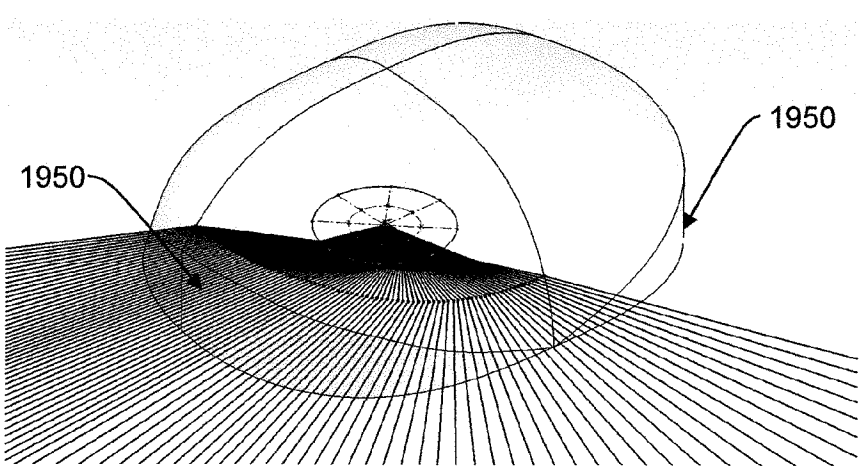

FIGS. 38A, 38B, 38C, and 38D illustrate views of an example optic 3700, 3750 for managing light emitted by a light emitting diode 2100 in accordance with some embodiments of the present technology. FIG. 38A shows the optic 3700 prior to eliminating optically inactive portions of optical material to promote manufacturing efficiency. FIG. 38B shows the optic 3750 after eliminating optically inactive portions of optical material to promote manufacturing efficiency. FIGS. 38C and 38D show the optic 3750 with overlaid ray traces in two views after eliminating optically inactive portions of optical material to promote manufacturing efficiency. In the illustrated embodiment, the rays bypass the resulting peripheral sidewalls 1950.

The optic 3750 can be designed to eliminated optically inactive regions as discussed above. In other words, truncation of the optic 3750 typically occurs in the design or engineering phase and may be implemented during manufacture by using a mold having appropriate contours. As discussed above, reducing the amount of material in the optic 3750 facilitates efficient manufacturing and promotes fast post molding cooling.

Figure 39B:
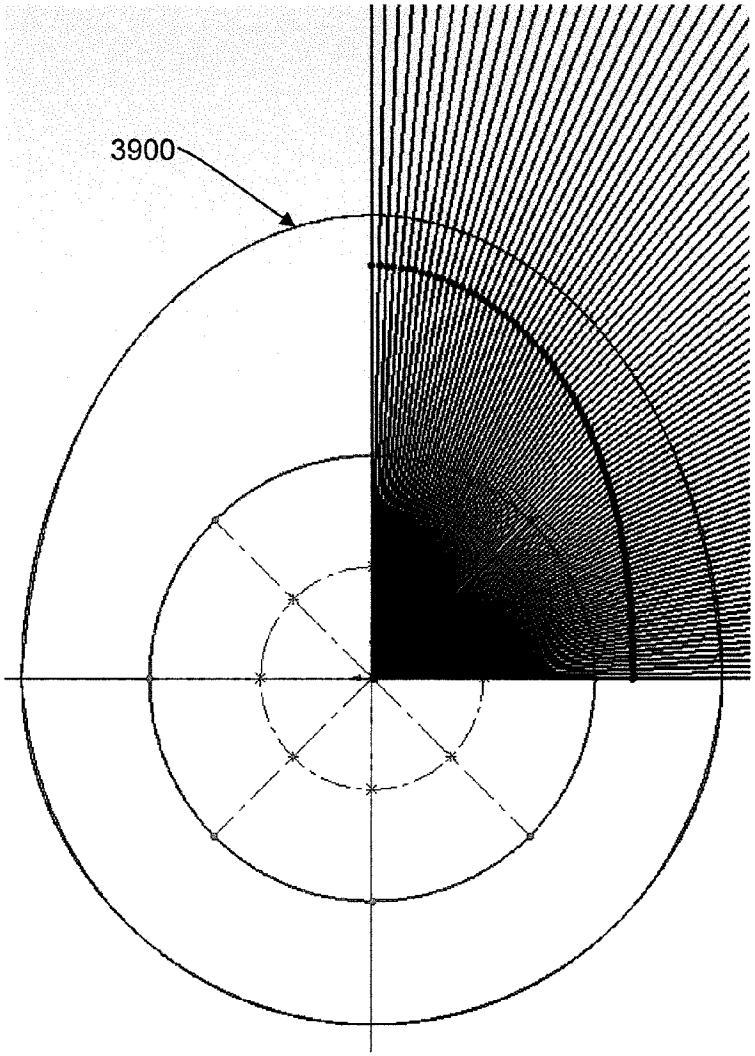
FIGS. 39A and 39B, collectively
Figure 39A:
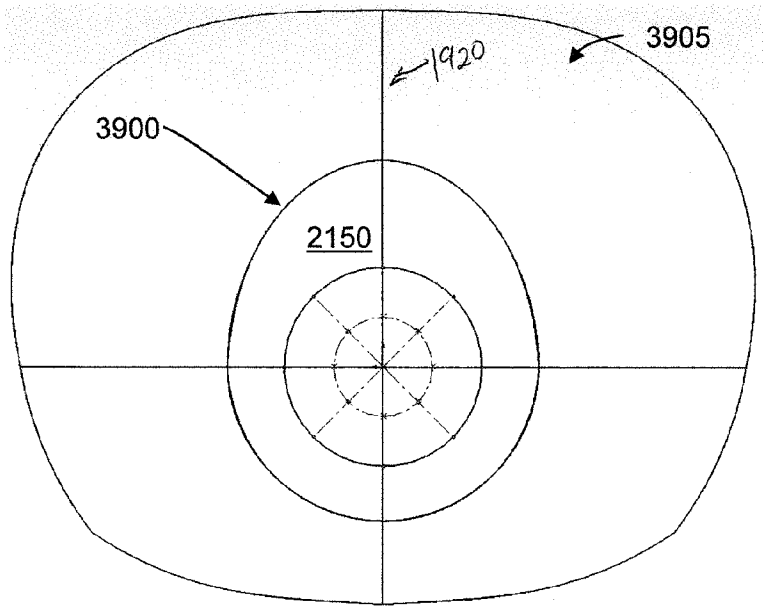

FIGS. 39A and 39B illustrate overhead views of an example optic 3905 for managing light emitted by a light emitting diode 2100 in accordance with some embodiments of the present technology. The views show a representative outline or footprint 3900 of a cavity 2150 of the optic 3905, where the outline 3900 is egg-shaped. The egg-shaped outline 3900 can be formed by a combination of two different ovals or ellipses that have different elongations, for example. In the illustrated embodiment, the egg-shaped outline 3900 is symmetrical about the line 1920 but is asymmetrical in the opposing dimension.

Technology for managing light emitted from a light emitting diode or other appropriate source has been described. From the description, it will be appreciated that an embodiment of the present technology overcomes the limitations of the prior art. Those skilled in the art will appreciate that the present technology is not limited to any specifically discussed application or implementation and that the embodiments described herein are illustrative and not restrictive. From the description of the example embodiments, equivalents of the elements shown therein will suggest themselves to those skilled in the art, and ways of constructing other embodiments of the present technology will appear to practitioners of the art. Therefore, the scope of the present technology is to be limited only by the claims that follow.

What is claimed is:

1. An illumination system comprising:

an optic comprising an interior surface that defines a cavity and an exterior surface opposite the interior surface; and a light emitting diode mounted to emit light into in the cavity, the light emitting diode having an axis, wherein the cavity comprises an egg-shaped outline perpendicular to the axis, and wherein the optic is operable to:

transmit and emit a first portion of the emitted light that is oriented in a street side direction;

with a region of the interior surface, focus a second portion of the emitted light that is oriented in a house side direction;

with an internally reflective surface, receive the focused second portion of the emitted light and redirect the focused second portion in the street side direction;

with a region of the exterior surface, receive a third portion of the emitted light that is oriented in a house side direction and internally reflect the received third portion to a backside of the optic; and with the backside of the optic, send street side a fraction of the internally reflected third portion.

2. The illumination system of claim 1, wherein the exterior surface comprises an optically inactive sidewall that extends peripherally at least partially about the cavity, the sidewall extending laterally.

3. The illumination system of claim 1, wherein the light emitting diode is part of a chip-on-board system, and wherein the egg-shaped outline comprises a first segment of a first ellipse and a second segment of a second ellipse, the first ellipse and the second ellipse having different elongations.

4. The illumination system of claim 1, wherein the optic is further operative to transmit at least some light that is oriented in the house side direction.

5. The illumination system of claim 1, wherein the light emitting diode is mounted on a substrate having a geometry, wherein the optic comprises a base that is substantially flat, wherein the egg-shaped outline is disposed between the base and the exterior surface, and wherein the cavity comprises a second outline that is disposed between the base and the egg-shaped outline, the second outline shaped in accordance with the geometry to receive the substrate.

6. The illumination system of claim 1, wherein the optic comprises a base and a channel formed in the base, the channel sized to receive one or more electrical lines for powering the light emitting diode.

7. The illumination system of claim 1, wherein the cavity further comprises a cross section having an irregularly shaped outline in which the light emitting diode and a circuit board are disposed.

8. An illumination system comprising:

an optic comprising:

an interior surface that defines a cavity, a backside disposed adjacent the cavity, and an exterior surface opposite the interior surface and the backside; and a light emitting diode (LED) disposed to emit light into the cavity;

wherein a first area of the exterior surface is disposed at least partially on a street side of the optic and is operative to transmit a first portion of light emitted by the LED in a street side direction, wherein a region of the interior surface focuses a second portion of the light emitted by the LED in a house side direction, wherein a second area of the exterior surface is oriented to receive the second portion of light and reflect the received second portion of light in the street side direction, and wherein a third area of the exterior surface is oriented to receive a third portion of light emitted by the LED in a house side direction and to internally reflect the received third portion of light incident on the backside.

9. The illumination system of claim 8, wherein the cavity has an egg-shaped outline.

10. The illumination system of claim 8, wherein a portion of the light incident on the backside is recycled back into the optic.

11. The illumination system of claim 8, wherein the light emitting diode is attached to a substantially flat substrate, and wherein the substantially flat substrate is disposed in a portion of the cavity that is irregularly shaped.

12. An illumination system, comprising:

an optic comprising:

a backside;

an exterior surface comprising an internally reflective surface and a first surface region; and a cavity comprising a second surface region, the cavity extending from the backside towards the exterior surface; and a light emitting diode mounted to emit light into the cavity, wherein the optic is operable to perform the steps of:

transmitting through the optic a first portion of the emitted light that is oriented in a street side direction;

with the second surface region, focusing a second portion of the emitted light that is oriented in a house side direction;

with the internally reflective surface, receiving the focused second portion of the emitted light and redirecting the focused second portion in the street side direction; and with the first surface region, receiving a third portion of the emitted light that is oriented in a house side direction and internally reflecting the received third portion to the backside of the optic, where the backside redirects a portion of incident light street side.

13. The illumination system of claim 12, wherein the cavity comprises a receptacle sized to receive a circuit board to which the light emitting diode is mounted.

14. The illumination system of claim 12, wherein the cavity is egg-shaped in cross section.

15. The illumination system of claim 12, wherein the optic further comprises an irregularly shaped receptacle.

16. The illumination system of claim 12, wherein redirecting the portion of incident light street side comprises recycling or returning incident light into the optic.

17. The illumination system of claim 12, wherein the exterior surface further comprises a refractive surface that transmits the first portion of the emitted light that is oriented in the street side direction.

18. The illumination system of claim 17, wherein the internally reflective surface is disposed between the first surface region and the refractive surface.

* * * * *

UNITED STATES PATENT AND TRADEMARK OFFICE

CERTIFICATE OF CORRECTION

PATENT NO. : 9,140,430 B2
APPLICATION NO. : 13/828670
DATED : September 22, 2015
INVENTOR(S) : Kevin Charles Broughton It is certified that error appears in the above-identified patent and that said Letters Patent is hereby corrected as shown below:

IN THE CLAIMS

Column 18, Claim 1, line 30, "a light emitting diode mounted to emit light into in the" should read -- a light emitting diode mounted to emit light into the --

Signed and Sealed this
Sixteenth Day of February, 2016

Michelle K. Lee

Michelle K. Lee
*Director of the United States Patent and Trademark Office*